US012799864B1

(12) United States Patent
Almani et al.

(10) Patent No.: US 12,799,864 B1
(45) Date of Patent: Nov. 17, 2026

(54) METHODS AND SYSTEMS FOR DETERMINING FORMATION PERMEABILITY

(71) Applicant: SAUDI ARABIAN OIL COMPANY, Dhahran (SA)

(72) Inventors: Tameem Almani, Dhahran (SA); Khaqan Khan, Dhahran (SA); Waheed Arshad, Mississauga (CA); Osman Hamid, Richmond, TX (US)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 5 days.

(21) Appl. No.: 19/210,600

(22) Filed: May 16, 2025

(51) Int. Cl.
*E21B 49/00* (2006.01)
*E21B 43/26* (2006.01)

(52) U.S. Cl.
CPC ..... *E21B 49/008* (2013.01); *E21B 43/26* (2013.01); *E21B 2200/20* (2020.05); *E21B 2200/22* (2020.05)

(58) Field of Classification Search
CPC .... E21B 49/008; E21B 43/26; E21B 2200/20; E21B 2200/22
USPC ..... 166/250.02
See application file for complete search history.

(56) References Cited

U.S. PATENT DOCUMENTS 6,944,546 B2 * 9/2005 Xiao ..... G01V 11/00 702/6
7,830,744 B2 * 11/2010 Wu ..... G01V 1/50 367/32
9,556,729 B2 1/2017 Lamei et al.
11,675,106 B2 * 6/2023 Almani ..... E21B 43/26 702/11
2017/0115420 A1 * 4/2017 Cazeneuve ..... G01V 1/50
2025/0052141 A1 2/2025 Almani et al.

OTHER PUBLICATIONS

T. Ito, et al., "Effect of pore pressure gradient on fracture initiation in fluid saturated porous media Rock," Engineering Fracture Mechanic, 2008 (10 pages).
T. Ito, et al., "Physical Background to the Breakdown Pressure in Hydraulic Fracturing Tectonic Stress Measurements," Int. J. Rock Mech. Min. Sci. & Geomech., 1991 (9 pages).
Y. Ding, et al., "The Research on Influence of Unloading on Borehole Stability in Clay-Rich Shale Formation," The Open Petroleum Engineering Journal, 2017 (16 pages).
Z.H. Yang, et al., "On Approximating the Modified Bessel Function of the Second Kind," Journal of Inequalities and Applications, 2017 (8 pages).
A. Khorram, et al., Modeling and Simulation of Oil Well Stimulation by High Power Ultrasonic Irradiation, Acta Acustica United With Acustica, 2017 (11 pages).

(Continued)

*Primary Examiner* — Tara Schimpf
*Assistant Examiner* — Patrick F Lambe
(74) *Attorney, Agent, or Firm* — Osha Bergman Watanabe & Burton LLP

(57) ABSTRACT

Various embodiments provide systems and methods for determining formation properties along a well within a formation, and more particularly to methods and systems for determining a formation permeability along a well within a formation.

18 Claims, 11 Drawing Sheets

(56) References Cited

OTHER PUBLICATIONS

B. Haimson, et al., "In Situ Stress Determination at Great Depth by Means of Hydraulic Fracturing," 11th Symposium on Rock Mechanics. W. Somerton, Society of Mining Engineers of AIME, 1970 (26 pages).
E. Fjar, et al., "Petroleum Related Rock Mechanics", Elsevier, 2008 (26 pages).
Z. Chen, et al., "Effect of Near-Wellbore Fracture Geometry on Fracture Execution and Post-Treatment Well Production of Deviated and Horizontal Wells," SPE Production & Operations, 1999 (10 pages).
Y. Feng, et al., "Parameters controlling pressure and fracture behaviors in field injectivity tests: A numerical investigation using coupled flow and geomechanics model," Computers and Geotechnics, 2017 (13 pages).
J. Zhang, et al., "Pore pressure prediction from well logs: Methods, modifications, and new approaches," Earth-Science Reviews, 2011 (14 pages).
T. Almani, et al., "Investigating the Effects of Permeability and Porosity Variations on Formation Breakdown Pressures Using a New Hybrid Analytical and Computational Approach," Paper presented at the International Petroleum Technology Conference, Riyadh, Saudi Arabia, Feb. 2022, IPTC-22568-MS (14 pages).
T. Almani, et al., "A New Computational Framework for Predicting Formation Breakdown Pressure in Hydraulic Fracturing Operations," Paper presented at the ARMA/DGS/SEG International Geomechanics Symposium, Virtual, Nov. 2021, ARMA-IGS-21-055 (12 pages).

* cited by examiner

METHODS AND SYSTEMS FOR DETERMINING FORMATION PERMEABILITY

BACKGROUND

Hydrocarbons can be used as fuel for power generation and transportation vehicles. Production of hydrocarbons often includes drilling wells into the ground from which hydrocarbons are extracted. The process of drilling wells uses drilling muds to facilitate the process of the drill bits drilling into rock and to prevent fluids from the subsurface causing unwanted issues. Drilling wells may cause damage to the rock by the drilling muds clogging rock pores which may lead to poor performance of the well in regard to production rates. Such poor performance of the well leads to higher costs and higher emissions as more wells will be needed to extract remaining hydrocarbons.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

In some aspects, the techniques described herein relate to a system for determining formation permeability along a well within a formation. The system includes a logging system, a formation analysis system, and a well development planning system. The logging system is configured to obtain a well parameter of the well. The formation analysis system is configured to determine a pore pressure based on the well parameter. The formation analysis system is configured to determine a poroelastic stress based on the pore pressure. The formation analysis system is configured to determine a breakdown pressure upper bound based on the poroelastic stress. The formation analysis system is configured to determine a modeled breakdown pressure based on the breakdown pressure upper bound. The formation analysis system is configured to determine, using a root-finding algorithm, a permeability prediction based on the modeled breakdown pressure. The well development planning system is configured to determine a well development plan based at least in part on the permeability prediction.

In some aspects, the techniques described herein relate to a method for determining formation permeability along a well within a formation. The method includes obtaining, using a logging system, a well parameter. The method includes obtaining, using a logging system, a permeability well log. The method includes determining a pore pressure based on the well parameter. The method includes determining a poroelastic stress based on the pore pressure. The method includes determining a breakdown pressure upper bound based on the poroelastic stress. The method includes determining a modeled breakdown pressure based on the breakdown pressure upper bound. The method includes determining, using a root-finding algorithm, a permeability prediction based on the modeled breakdown pressure. The method includes determining a well development plan based on the permeability prediction.

Other aspects and advantages of the claimed subject matter will be apparent from the following description and the appended claims.

BRIEF DESCRIPTION OF DRAWINGS

Specific embodiments of the disclosed technology will now be described in detail with reference to the accompanying figures. Like elements in the various figures are denoted by like reference numerals for consistency.

DETAILED DESCRIPTION

Figure 1:
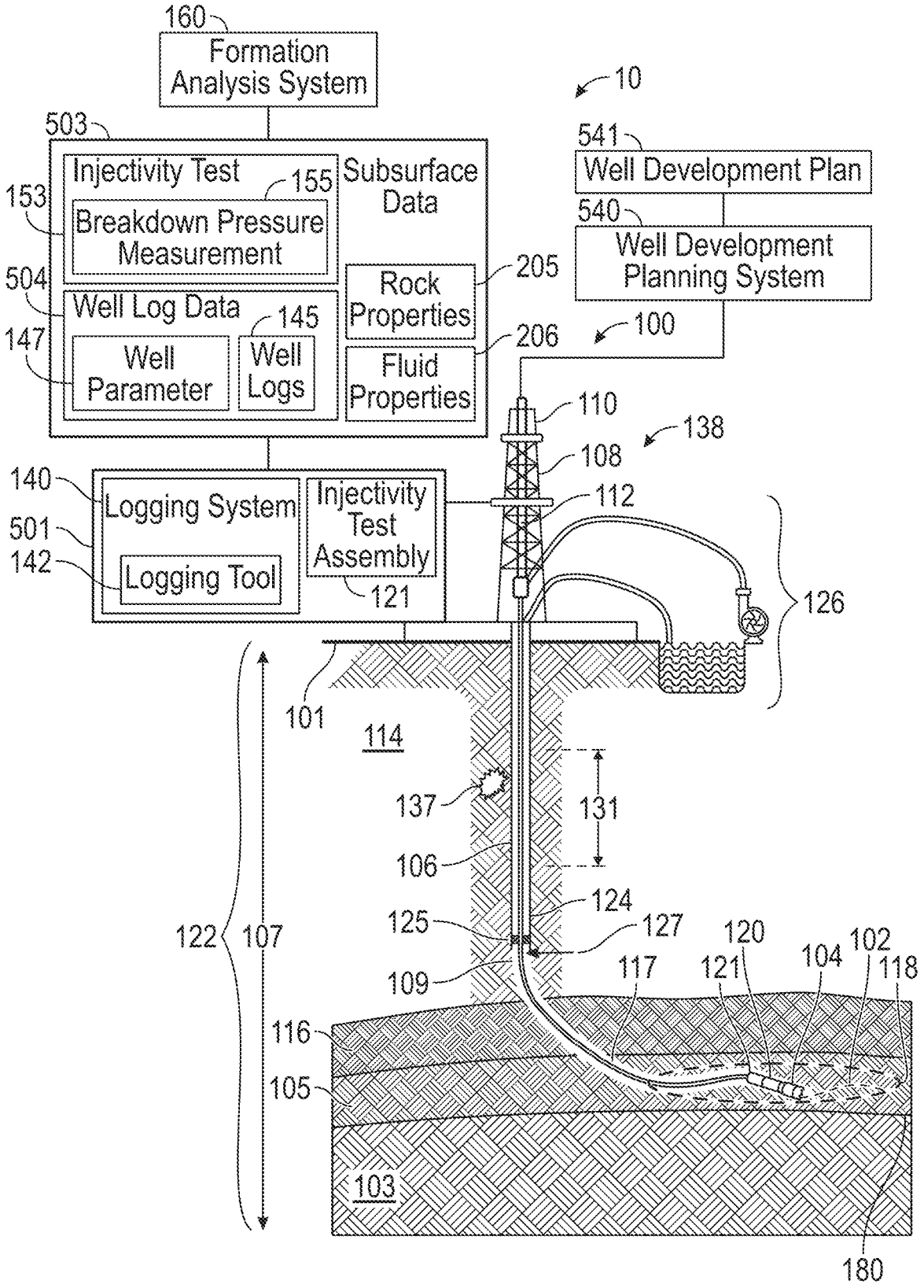
FIG. 1 depicts a well with a formation permeability estimation system in accordance with one or more embodiments.

In the following detailed description of embodiments of the disclosure, numerous specific details are set forth in order to provide a more thorough understanding of the disclosure. However, it will be apparent to a person having ordinary skill in the art that the disclosure may be practiced without these specific details. In other instances, well-known features have not been described in detail to avoid unnecessarily complicating the description.

Throughout the application, ordinal numbers (e.g., first, second, third, etc.) may be used as an adjective for an element (i.e., any noun in the application). The use of ordinal numbers is not to imply or create any particular ordering of the elements nor to limit any element to being only a single element unless expressly disclosed, such as using the terms "before," "after," "single," and other such terminology. Rather, the use of ordinal numbers is to distinguish between the elements. By way of an example, a first element is distinct from a second element, and the first element may encompass more than one element and succeed (or precede) the second element in an ordering of elements.

It is to be understood that the singular forms "a," "an," and "the" include plural referents unless the context clearly dictates otherwise.

Terms such as "approximately," "substantially," etc., mean that the recited characteristic, parameter, or value need not be achieved exactly, but that deviations or variations, including for example, tolerances, measurement error, measurement accuracy limitations and other factors known to those of skill in the art, may occur in amounts that do not preclude the effect the characteristic was intended to provide.

It is to be understood that one or more of the steps shown in the flowchart may be omitted, repeated, and/or performed in a different order than the order shown. Accordingly, the scope disclosed herein should not be considered limited to the specific arrangement of steps shown in the flowchart.

Although multiple dependent claims are not introduced, it would be apparent to a person having ordinary skill that the subject matter of the dependent claims of one or more embodiments may be combined with other dependent claims.

In the following description of FIGS. 1-9, any component described with regard to a figure, in various embodiments disclosed herein, may be equivalent to one or more like-named components described with regard to any other figure. For brevity, descriptions of these components will not be repeated with regard to each figure. Thus, each and every embodiment of the components of each figure is incorporated by reference and assumed to be optionally present within every other figure having one or more like-named components. Additionally, in accordance with various embodiments disclosed herein, any description of the components of a figure is to be interpreted as an optional embodiment which may be implemented in addition to, in conjunction with, or in place of the embodiments described with regard to a corresponding like-named component in any other figure.

Methods and systems for determining formation permeability are disclosed herein. A method for determining formation permeability may include obtaining, using a logging system, a well parameter. The method may include determining a pore pressure based on the well parameter. The method may include determining a poroelastic stress based on the pore pressure. The method may include determining a breakdown pressure upper bound based on the poroelastic stress. The method may include determining a modeled breakdown pressure based on the breakdown pressure upper bound. The method may include determining, using a root-finding algorithm, a permeability prediction based on the modeled breakdown pressure. The method may include determining a well development plan based on the permeability prediction.

FIG. 1 illustrates a system for determining formation permeability (hereafter "permeability modeling system" (10)) including a well (100) and a drilling system (138) in accordance with one or more embodiments. The particular well configuration of equipment and system and well shown are in accordance with one embodiment, and based upon the disclosure provided herein one of ordinary skill in the art will recognize a variety of well types and configurations of well equipment and systems that are possible in accordance with other embodiments. As shown in FIG. 1, a wellbore (117) having a plurality of depths (107) may be drilled by a drill bit (104) attached by a drillstring (106) to a drill rig located on the surface (101) of the earth. The plurality of depths (107) may be a measured distance (i.e., a measured depth) from a wellbore surface location along the wellbore (117) and may not be a true vertical depth. The drill rig may include framework, such as a derrick (108) to hold drilling machinery. The top drive (110) sits at the top of the derrick (108) and provides clockwise torque via the drive shaft (112) to the drillstring (106) in order to drill the wellbore (117). The wellbore (117) may be a curved wellbore path, or a straight wellbore path. All or part of the wellbore (117) may be vertical, and some wellbore paths may be deviated or have horizontal sections. The wellbore (117) may traverse a plurality of overburden (114) layers and one or more caprock (116) layers to a reservoir (105) having a production fluid such as hydrocarbons within the subterranean region of interest having one or more formations (103).

The subterranean region of interest (hereafter "subsurface" (122)) may consist of layers of rock such as the one or more formations (103) such as the reservoir (105), separated by geologic boundaries (180). Some rock layers may reside above the hydrocarbon reservoir (105) and may be referred to as "overburden rock," or simply "overburden" (114). The hydrocarbon reservoir (105) may also be a source rock (i.e., the rock from which the hydrocarbon was released), or may be adjacent to the source rock. For example, an unconventional hydrocarbon reservoir (105) may be shale rock. Hereinafter, any rock within the subsurface (122) may be referred to as "in situ rock" or simply "rock."

In situ rock at different locations within the subsurface (122) may experience differing states of stress. Stress is a physical quantity of measuring the force of one particle applied to another particle of a given material or object (e.g., rock), and is typically measured as the force per cross-sectional area. The stress state at a given location or point is characterized by various stress components, including normal stress or shear stress. As stress is a tensor, the force per unit area is associated with two directions, the direction of the applied force and the direction normal to the plane to which the force is applied. Normal stresses refer to the stress tensor components for which the two directions coincide and may be compressional or tensile, while shear stresses refer to stress tensor components where the two directions are normal to one another.

The stress state of in situ rock at each location may be caused, in part, by various geological phenomena, such as overburden (114) weight, tectonics, thermal processes, or glacial rebound. The stress state of rock may also be caused by anthropomorphic activities that affect the in situ rock, such as drilling the wellbore (117), well completion strategies, mining tunnels, or hydrocarbon or other fluid recovery. For example, in situ rock deep within the subsurface (122) may present a higher (vertical) stress state relative to in situ rock near the surface (101) due to overburden (114) pressure, i.e., pressure from overburden (114) weight. In another example, drilling the wellbore (117) within the subsurface (122) may result in cracked or weakened in situ rock that relieves some of the stress present prior to drilling the well (100). The weakened in situ rock may be manifested by wellbore breakout where portions of rock along a wellbore wall (109) may collapse and break off. The wellbore breakout may occur in certain azimuthal directions that may be indicative of the stress state of the in situ rock.

Prior to the commencement of drilling, a well development plan (541) may be generated. The well development plan (541) may include a wellbore plan, a completion plan, a stimulation plan, and a well remediation plan. The well development plan may include each of the wellbore plan, the completion plan, the stimulation plan, and the well remediation plan separately, may integrate two or more elements into a combined plan, or all of the elements into a single integrated well development plan. For example, the well development plan (541) may include specifications relating to the well trajectory, the density of drilling mud to be used, and the size of the drill bit and the resulting intended diameter ("caliper") of the wellbore (117). Similarly, the completion plan may include specifications of the diameter, wall thickness and material of the casing as well as the location and size of downhole or surface pumps. Further, the stimulation plan may specify the pumping schedule for pressurizing the wellbore (117) until a formation breakdown pressure is reached and a proppant material and pumping schedule for injecting proppant (sand) into the hydraulic fracture resulting from the breakdown of the formation (103). The remediation plan may specify well remediation operations to repair porosity and permeability of the rock surrounding the wellbore (117) that may have been damaged due to drilling operations such as mud infiltration into the pore space.

The well development plan (541) may include a starting surface location of the wellbore (117), or a subsurface location within an existing wellbore, from which the wellbore (117) may be drilled. Further, the well development plan (541) may include a terminal location that may intersect with a target zone (118) (e.g., a targeted hydrocarbon-bearing formation) and a planned wellbore path (102) from the starting location to the terminal location. In other words, the wellbore (117) may intersect a previously located hydrocarbon reservoir (105).

Typically, the well development plan (541) is generated based on best available information at the time of planning from a geophysical model, geomechanical models encapsulating subterranean stress conditions, the trajectory of any existing wellbores (which it may be desirable to avoid), and the existence of other drilling hazards, such as shallow gas pockets, over-pressure zones, and active fault planes.

The well development plan (541) may include wellbore geometry information such as wellbore diameter and inclination angle. If casing (124) is used, the well development plan (541) may include casing type or casing depths. Furthermore, the well development plan (541) may consider other engineering constraints such as the maximum wellbore curvature ("dog-log") that the drillstring (106) may tolerate and the maximum torque and drag values that the drilling system (138) may tolerate.

A well development planning system (540) may be used to generate the well development plan (541). The well development planning system (540) may include a computer system such as the computer system (700) described in relation to FIG. 7 that includes one or more processors in communication with computer memory containing geophysical, geological, and geomechanical models, information relating to drilling hazards, and the constraints imposed by the limitations of the drillstring (106) and the drilling system (138). The well development planning system (540) may further include dedicated software to determine the planned wellbore path (102) and associated drilling parameters, such as the planned wellbore diameter, the location of planned changes of the wellbore diameter, the planned depths at which casing (124) will be inserted to support the wellbore (117) and to prevent formation fluids entering the wellbore (117), and the drilling mud weights (densities) and types that may be used during drilling the wellbore (117). Formation fluids may include the production fluid (e.g., hydrocarbons) and/or formation water.

The wellbore (117) may be drilled using a drill rig that may be situated on a land drill site, an offshore platform, such as a jack-up rig, a semi-submersible, or a drill ship. The drill rig may be equipped with a hoisting system, such as a derrick (108), which can raise or lower the drillstring (106) and other tools required to drill the well (100). The drillstring (106) may include one or more drill pipes connected to form conduit and a bottom hole assembly (BHA) (120) disposed at the distal end of the drillstring (106). The BHA (120) may include the drill bit (104) to cut into subsurface (122) rock. The BHA (120) may further include measurement tools, such as a measurement-while-drilling (MWD) tool and logging-while-drilling (LWD) tool. MWD tools may include sensors and hardware to measure downhole drilling parameters, such as the azimuth and inclination of the drill bit, the weight-on-bit, and the torque. The LWD measurements may include sensors, such as resistivity, gamma ray, and neutron density sensors, to characterize the rock formation surrounding the wellbore (117). Both MWD and LWD measurements may be transmitted to the surface (101) using any suitable telemetry system, such as mud-pulse or wired-drill pipe, known in the art. The BHA (120) may include a positioning system for communicating positioning and direction of the drill bit relative to the surface location. The positioning system may include gyroscopes, magnetometers, and accelerometers to determine a wellbore's inclination and azimuth while drilling.

To start drilling, or "spudding in" the well, the hoisting system lowers the drillstring (106) suspended from the derrick (108) towards the planned surface location of the wellbore (117). An engine, such as a diesel engine, may be used to supply power to the top drive (110) to rotate the drillstring (106). The weight of the drillstring (106) combined with the rotational motion enables the drill bit (104) to bore the wellbore (117).

The near-surface is typically made up of loose or soft sediment or rock, so large diameter casing (124), e.g., "base pipe" or "conductor casing," is often put in place while drilling to stabilize and isolate the wellbore (117). At the top of the base pipe is the wellhead, which serves to provide pressure control through a series of spools, valves, or adapters. Once near-surface drilling has begun, water or drill fluid may be used to force the base pipe into place using a pumping system until the wellhead is situated just above the surface (101) of the earth.

Drilling may continue without any casing (124) (i.e., an "open hole" wellbore), once deeper, or more compact rock is reached. While drilling, a drilling mud system (126) may pump drilling mud from a mud tank on the surface (101) through the drill pipe. Drilling mud serves various purposes, including pressure equalization, removal of rock cuttings, or drill bit cooling and lubrication.

At planned depth intervals, drilling may be paused and the drillstring (106) withdrawn from the wellbore (117). Sections of casing (124) may be connected and inserted and cemented into the wellbore (117). Casing string or a production liner may be cemented in place by pumping cement and mud (i.e., "cemented liner"), separated by a "cementing plug," from the surface (101) through the drill pipe. The cementing plug and drilling mud force the cement through the drill pipe and into the annular space between the casing (124) and the wellbore wall (109). Once the cement cures, drilling may recommence. The drilling process is often performed in several stages. Therefore, the drilling and casing cycle may be repeated more than once, depending on the depth of the wellbore (117) and the pressure on the wellbore wall (109) from surrounding rock.

Prior to drilling the next section of the wellbore (117) after the previous section of the wellbore (117) has been cased and cemented, the drilling system (138) may perform an injectivity test (153). After the casing (124) has been cemented of the previously drilled section, the drillstring (106) may be disposed in the wellbore (117), and a short segment of the wellbore (117) is drilled, for example, 10 feet of the wellbore (117) is newly drilled. The injectivity test (153) may be performed on the formation (103) surrounding the newly drilled section of the wellbore (117).

In accordance with one or more embodiments, the BHA (120) may include an injectivity test assembly (121). The injectivity test assembly (121) is configured to inject an injection fluid into the formation (103) to perform the injectivity test (153) such as a leak-off test ("LOT") or a formation integrity test ("FIT") as known to a person having ordinary skill in the art. The injection test assembly may include one or more packers (125) to seal the annulus of the wellbore (117) between the casing (124) and the drillstring (106) to perform the injectivity test (153). The injectivity test (153) is configured to determine a breakdown pressure measurement (155) (i.e., a pressure where the formation fails and forms cracks and/or fractures within the rock). In some embodiments, the injectivity test may be performed at one of the plurality of depths (107) (e.g., a first one (127)) within the wellbore (117) or at multiple depths within the well (100). The injection fluid (e.g., drilling mud) may be pumped from the surface (101) through the drillstring (106) and out the distal end of the drillstring (106) to pressurize the formation (103) surrounding the newly drilled section of the wellbore (117). The injection fluid is injected into the formation until there is a release or "break" in the pressure within the wellbore (117) signaling that the formation has begun to crack and/or fracture. The pressure at which the formation begins to fracture is a leak-off pressure. The injectivity test assembly may continue to inject the injection fluid until the formation completely fails where fractures form and injection fluid penetrates into the fractures and formation. The pressure at which the formation fails completely is the formation breakdown pressure. The injectivity test assembly (121) may be configured to store pressure data such as a leak-off pressure measurement and the breakdown pressure measurement (155) on local computer memory which is to be retrieved when the BHA (120) is pulled out of the wellbore (117) or the injectivity test assembly (121) may be configured to transmit the data to the logging system to be stored and/or processed.

Due to the high pressures experienced by deep wellbores, a blowout preventer (BOP) may be installed at the wellhead to protect the rig and environment from unplanned oil or gas releases. As the wellbore (117) becomes deeper, both successively smaller drill bits and casing string may be used. Drilling deviated or horizontal wellbores may require specialized drill bits or drill assemblies.

The drilling system (138) may be disposed at the well (100) and communicate with other systems in the permeability modeling system (10). The drilling system (138) may control at least a portion of a drilling operation by providing controls to various components of the drilling operation. In one or more embodiments, the system may receive data from one or more sensors arranged to measure controllable parameters of the drilling operation. As a non-limiting example, sensors may be arranged to measure weight-on-bit, drill rotational speed (RPM), flow rate of the mud pumps (GPM), and rate of penetration of the drilling operation (ROP). Each sensor may be positioned or configured to measure a desired physical stimulus. Drilling may be considered complete when the target zone (118) is reached, or the presence of hydrocarbons is established.

The permeability modeling system (10) includes one or more formation property acquisition systems (501) such as a logging system (140) and the injectivity test assembly (121). The one or more formation property acquisition systems (501) are available for determining various reservoir characteristics such as one or more rock properties (205) and one or more fluid properties (206). The various reservoir characteristics may be determined at one or more locations within the subsurface (122). The formation property acquisition systems are configured to acquire subsurface data (503) such as one or more well logs (145), one or more well parameters (147), and/or the breakdown pressure measurement (155).

The logging system (140) includes the one or more logging tools (142), such as a sonic logging tool, a nuclear magnetic resonance (NMR) logging tool, and/or a caliper tool (not shown), for use in generating the one or more well logs (145) of the subsurface (122). The one or more well logs (145) (e.g., a sonic well log and/or an NMR well log) include well log data acquired by the logging system (140). In some embodiments, the well log data may be acquired at each of the plurality of depths (107) within the well (100). In some embodiments, the well log data may be acquired at each of the plurality of depths (107) within a depth interval (131). The one or more logging tools (142) may be incorporated into the MWD tool or the LWD tool as described above or may be maneuvered via a wireline using a spooling device configured to adjust the length of wireline. For example, the logging tool (142) may be lowered into the wellbore (117) to acquire well log data at each of the plurality of depths (107) within the well (100) (or within the depth interval (131)) as the tool traverses the depth interval (131) (for example, targeted reservoir section) of the wellbore (117).

In some embodiments, one or more source activation locations (137) (also known as firing/excitation location) are locations at which a logging tool source generates a tool signal as the logging tool (142) is maneuvered either by the drillstring (106) or the wireline. The plot of well log data versus depth may be referred to as a "log" or "well log." Well logs (145) may provide depth measurements of the well (100) that describe such reservoir characteristics as formation porosity, formation transit time, formation permeability, resistivity, water saturation, and the like. Well logs (145) may also be derived from processing and mathematically transforming other well logs. The resulting well log data may be stored as "raw" well logs or processed or both, for example, by the formation analysis system (160), to generate corresponding well logs (145) for the well (100). A sonic well log may include, for example, recorded sonic waveforms versus true vertical depth (TVD) across the depth interval (131).

Based upon the disclosure provided herein, one of ordinary skill in the art will recognize a variety of types of logging tools and/or techniques that may be used in relation to different embodiments for determining various formation characteristics at each of the plurality of depths (107) within the wellbore (117) (or within the depth interval (131)). A particular form of logging may be selected and used based on the logging conditions and the type of desired measurements. For example, sonic logging measures an interval transit time of the formation (103). Thus, sonic logs may measure one or more velocities of sonic compressional and/or shear waves through the formation (103). In so doing, sonic logs may be used alone, or in combination with other logs, to determine both porosity and permeability as well as the types of fluids present in the pore spaces. In some embodiments, wellbore imaging tools may be used to image the subsurface (122). Wellbore imaging tools may include optical imaging tools, electrical imaging tools, acoustic imaging tools, or in combinations thereof.

In various embodiments, determining permeability may be done using, for example, an NMR log. Based upon the disclosure provided herein, one of ordinary skills in the art will recognize other types of logs that may be used for determining permeability in relation to different embodiments. An NMR well log may determine the porosities and the permeabilities of rocks in the formation (103) by measuring the amount of nuclear magnetic resonance that are scattered back to a gamma ray detector disposed in the density logging tool. The NMR logging tool source emits magnetic field. The emitted magnetic field interacts with the nuclei within the formation (103). The nuclei of hydrogen atoms have a strong response to the magnetic field relative to most other atoms. The interaction of the emitted magnetic field with the nuclei of hydrogen causes a magnetic moment response amplitude. The magnitude of the amplitude is related to the amount of hydrogen within the formation which in turn is related to the porosity, $\phi$. The rate of decay of the NMR signal amplitude is related to the permeability, K, of the formation (103).

To determine travel times in the formation (103), various types of logging techniques may be used. For example, the logging system (140) may measure the speed that acoustic waves travel through rocks in the formation (103). This type of logging may generate compressional and/or shear wave sonic logs, which are also called sonic logs and acoustic logs. In general, sound waves may travel faster through shales than through sandstones because shales generally have greater density than sandstones. Likewise, density logging may also determine density measurements by directly measuring the density of the rocks in the formation (103). In addition, neutron logging may determine porosity measurements by assuming that the reservoir pore spaces within the formation (103) are filled with either water or oil and then measuring the amount of hydrogen atoms (that is, neutrons) in the pores. Furthermore, the logging system (140) may determine geological data for the formation (103) by measuring corresponding well logs (145) for the wellbore (117).

For determining borehole breakout, various types of logging techniques may be used such as sonic well logging, and caliper well logging. The BHA (120) may include a caliper logging tool that measures wellbore diameter thickness in one or more directions using one or more caliper arms that extend from the tool until the caliper arm contacts the wellbore wall (109). The amount of extension of the caliper arm is related to the wellbore diameter thickness. The caliper well data may detect wellbore wall instability where the rock has broken off which results in a wellbore thickness greater than the drill bit drilling thickness. The breakout may occur in relation to a maximum, $S_H$, and a minimum, $S_h$, horizontal stresses as described in relation to FIG. 2. The azimuth of the breakout is related to the direction of the maximum, $S_H$, and the minimum, $S_h$, horizontal stresses. The magnitude of the minimum horizontal stress, $S_h$, may be measured using the injectivity test assembly (121). As the cracks and/or fractures close after being opened during injection, the closing of the cracks may be detected in the pressure data obtained by the injectivity test assembly (121) and may represent the minimum horizontal stress, $S_h$. Magnitude of the maximum horizontal stress, $S_H$, may be determined using rock mechanic models of which a person having ordinary skill in the art would be knowledgeable.

Figure 2:
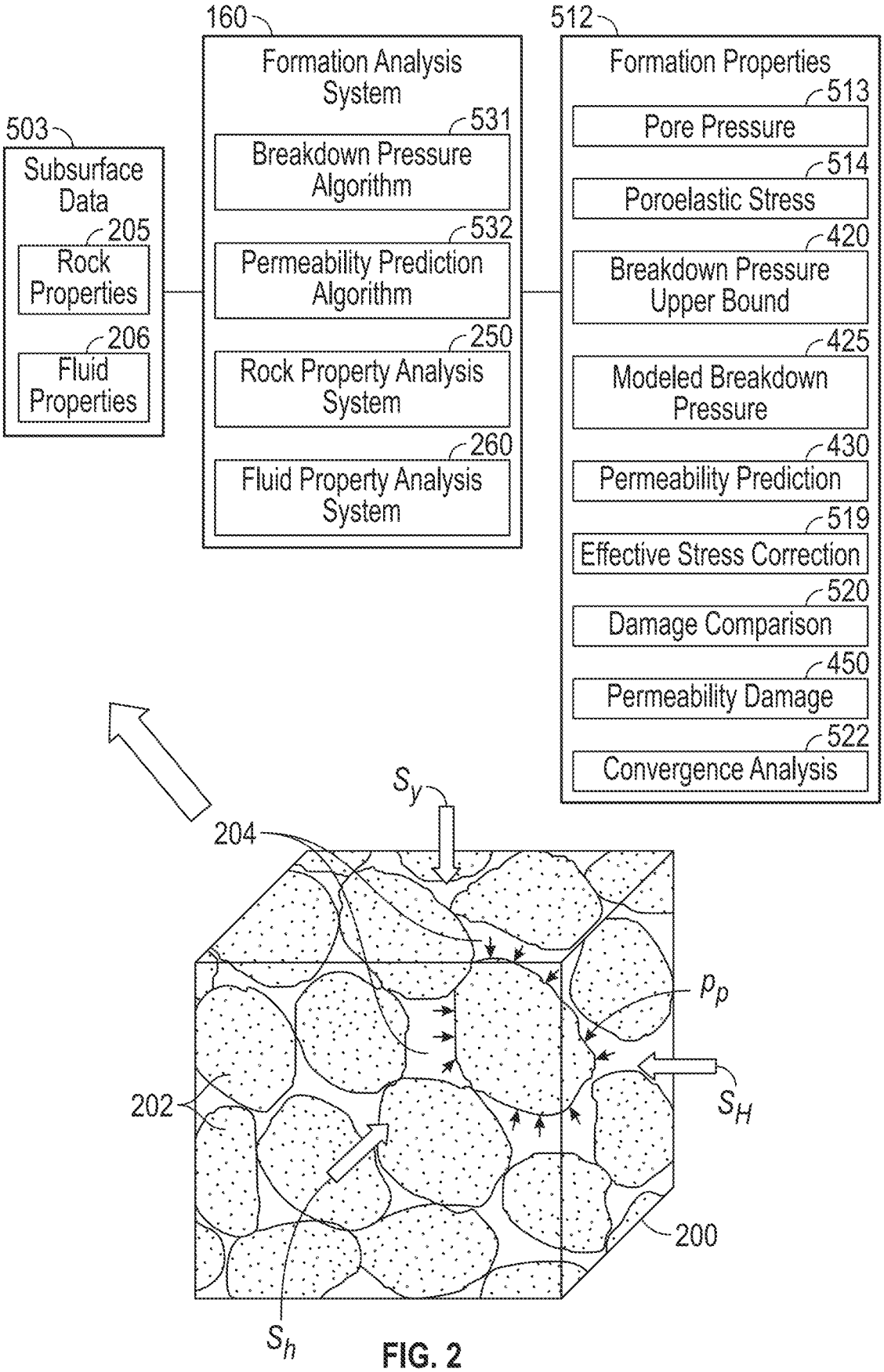
FIG. 2 depicts an example portion of a rock from which a formation property acquisition system acquires subsurface data in accordance with one or more embodiments.
Figure 3:
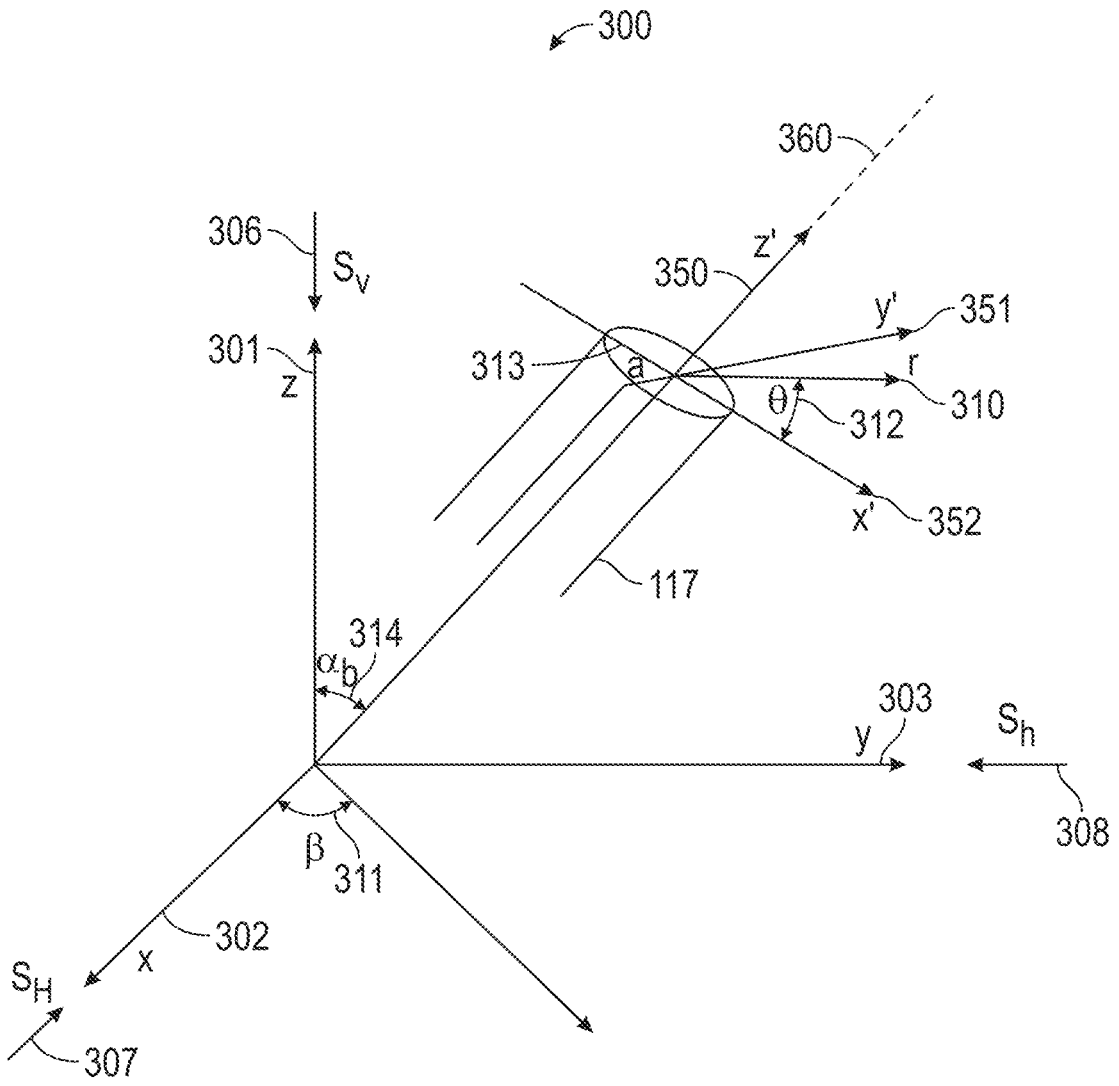
FIG. 3 depicts a well in a coordinate system in accordance with one or more embodiments.

In some embodiments, the logging system (140) may be configured to obtain one or more well parameters (147) including, but not limited to: an initial wellbore pressure, $P_0$, the inclination angle of the wellbore (117), $\alpha_b$, in relation to vertical, and an azimuth angle of the wellbore (117) relative to a reference direction, $\beta$, such as direction of the maximum horizontal stress, $S_H$ as described in relation to FIG. 2 and FIG. 3. The logging system (140) includes hardware and/or software configured to obtain the one or more well parameters (147) such as, but not limited to, pressure gauges, gyroscopes, magnetometers, and accelerometers for determining the wellbore angles of inclination and azimuth while drilling. Further, in some embodiments the logging system (140) may be configured to obtain fluid parameters such as injection fluid viscosity, $\mu$, and injection fluid compressibility, $c_f$. The logging system (140) may be configured to determine the maximum, $S_H$, the minimum, $S_h$, horizontal stresses and the vertical stress $S_v$. The maximum, $S_H$, and the minimum, $S_h$, horizontal stresses may be determined using caliper well data to determine wellbore breakout. The well log data, the breakdown pressure measurement (155), and the seismic data are influenced by formation characteristics of the formation (103).

While FIG. 1 shows various configurations of components, other configurations may be used without departing from the scope of the disclosure. For example, various components in FIG. 1 may be combined to create a single component. As another example, the functionality performed by a single component may be performed by two or more components.

FIG. 2 illustrates an example portion of a rock (200) from which the formation property acquisition system (501) acquires subsurface data (503) in accordance with one or more embodiments. As shown in FIG. 2, the constituents of the rock (200) may include grains (202) and pores (204), where the pores (204) make up the void spaces between the grains (202). The grains (202) may be a material made up of, without limitation, quartz, calcite, volcanic material, or kerogen. The pores (204) may be saturated with fluid, such as air, natural gas, oil, water, brine, or any mixture thereof. For example, the rock (200) of an unconventional hydrocarbon reservoir (105) may consist of shale grains (202) with pores (204) saturated with hydrocarbons and may be considered source rock. In some embodiments, the formation analysis system (160) may be configured to determine some of the subsurface data (503) such as the one or more rock properties (205) and the one or more fluid properties (206). In some such embodiments, the formation analysis system (160) may include a rock property analysis system (250) and a fluid property analysis system (260).

In accordance with one or more embodiments, the rock property analysis system (250) may be configured to receive a portion of the rock (200) and to conduct mechanical testing on the portion of the rock (200) to determine the one or more rock properties (205). The fluid property analysis system may be configured to receive a portion of the fluid from the formation and to conduct mechanical testing on the portion of the fluid to determine the one or more fluid properties (206). Based upon the disclosure provided herein, one of ordinary skill in the art will recognize a variety of mechanical testing may be performed by a number of methods that may be used in relation to different embodiments without departing from the scope of the invention.

The material of the grains (202) and the fluid saturating the pores (204) of the rock (200) may dictate the one or more rock properties (205), which include the physical properties, mechanical behavior, or mechanical parameters of the rock (200). For example, physical properties may include porosity, permeability, or pore pressure. Porosity is defined as the fraction of the volume of the rock (200) that is occupied by the pores (204). Mathematically, porosity, $\varnothing$, is the open space in a rock (200) divided by the total rock (200) volume. For example, unconventional hydrocarbon reservoirs (105) may have a low porosity, e.g., under 5%.

Permeability, K, is a measure of the ease of flow of a fluid through a porous rock (200), or in other words, it is a measure of the ability of the rock (200) to transmit fluids, typically measured in millidarcies (mD). The permeability of the rock (200) is related to its porosity, but also depends on the shapes of the pores (204) in the rock and their level of connectedness. That is, the degree of connection between the pores (204) and the viscosity of the fluid saturating the pores (204) may constrain permeability.

Permeability K may be determined in the lab by application of Darcy's law, which connects the gradient of pressure and flow velocity in rocks via their permeability. Permeability typically needs to be measured but may be estimated using empirically derived formulas.

Pore pressure (513), $p_p$, may be defined as the pressure that the fluids saturating the pores (204) apply to the grains (202) of the rock (200) and may also be related to a vertical stress. Vertical stress, $S_v$, is typically the stress caused by the weight of overburden (114) rock. Effective stress, $\sigma_e$, may control the mechanical behavior of the rock (200) and may be represented by a function of the pore pressure (513), $p_p$, and the vertical stress acting on the rock (200). That is, in some embodiments, the effective stress, $\sigma_e$, may be modeled as:

$$\sigma_e = S_v - \alpha p_p, \tag{1}$$

where $\alpha$ is Biot's poroelastic parameter. The effective stress $\sigma_e$ may quantify the stress state of the rock (200), as the vertical stress is supported partly by the grains (202) and partly by the fluid in the pores (204). However, a person having ordinary skill in the art will appreciate that effective stress may be modeled differently than in Eq. (1). The Biot poroelastic parameter, $\alpha$, may be defined as the volume of fluid change induced by the change in bulk volume when the rock (200) is void of fluid and may be a value between zero and one. The Biot poroelastic parameter may be determined through mechanical testing of the rock in a completely dry state and a fully saturated state while under pressure.

The pores (204) saturated by fluid of the rock (200) may present viscoelastic behavior, meaning that any fluid present may exhibit both viscous behavior and elastic behavior. Viscous behavior may be quantified by the viscosity of the fluid saturating the pores (204), where viscosity is a measure of the rate of resistance of the fluid to deform when a force is applied or removed. Fluids present in the pores (204) may include hydrocarbons, water, drilling mud, and/or an injection fluid. For example, the injection fluid may include an injection fluid viscosity, $\mu$, that may quantify the viscous behavior of the injection fluid.

The fluids present in the pores (204) includes a fluid compressibility property for each fluid present. The fluid compressibility property may be quantified by the compressibility of the fluid which is defined as any relative volume change of the fluid when a pressure is applied. For example, the injection fluid may include an injection fluid compressibility, $c_f$, that quantifies the compressibility of the injection fluid. The fluid compressibility may be determined by testing of the fluid and measuring volume change when confining pressure is varied. The characteristics of the fluid may dictate one or more fluid properties (206) such as the fluid viscosity, the fluid compressibility.

Turning to the mechanical behavior of rock (200), the material of the grains (202) may present elastic behavior or plastic behavior depending on the magnitude of the applied force. The grains (202) may present elastic behavior when small forces are applied. In the elastic range, the grains (202) will return to their undeformed shape following the removal of a small force. The grains (202) may present plastic behavior when large forces are applied. In the plastic range, the grains (202) will partially maintain a deformed shape following the removal of a large force. However, in either the elastic or plastic range, the framework made up of the grains (202) may also consolidate or compact due to an applied force.

The tensile strength, $\sigma_f$, of a rock (200) is the capacity of the rock (200) to resist forces applied in tension (e.g., a pulling force) per unit area without failure. The tensile strength of a rock (200) is commonly expressed in pounds per square inch (psi) or megapascals (MPa) and may be determined through laboratory rock mass strength experiments such as the Brazilian test or direct tensile test. The tensile strength, $\sigma_f$, of a rock may be determined by mechanical testing.

The mechanical behaviors of rock (200) may be quantified and modeled using various rock properties and their relationships. The rock properties (205) and the fluid properties (206) may be used to determine a modeled breakdown pressure (425). The modeled breakdown pressure (425) is to predict the formation breakdown pressure based on the rock properties (205) and the fluid properties (206). The formation breakdown pressure is closely related to in situ rock stresses.

An externally applied mechanical stress can elastically and reversibly alter the grains (202) of a rock (200), which is referred to as strain. Poisson's ratio $\nu$ is an elastic property of a material, such as rock (200). Specifically, Poisson's ratio describes the proportional decrease/increase in a lateral measurement to the proportional increase/decrease in length in a sample of material that is elastically stretched/compressed.

The stress state of the rock (200) may also affect its grains (202) and pores (204). The general state of stress at a point within a subsurface (122) may be characterized by independent shear and normal stress components, represented by a stress tensor. Further, the combination of the state of stress for every point in the subterranean region may be referred to as the stress field. For example, the in situ stress state may be the original stress status in the rock (200) before excavations or other perturbations and may typically coincide with vertical and horizontal directions (components).

If the stresses acting on the rock (200) are normal or perpendicular to the rock (200), the stresses may be referred to as "principal stresses." The principal in situ stress tensor may consist of a vertical stress (e.g., the overburden stress, $S_v$), and two horizontal stresses, $S_h$ and $S_H$. For example, FIG. 2 shows principal stresses as one vertical stress $S_v$ and two horizontal stresses, $S_h$ and $S_H$, acting on the rock (200)

Defining effective stress, $\sigma_e$, using Equation (1) may be used to model an "isotropic" stress state of rock (200) as only one principal stress (i.e., vertical stress $S_v$) is considered; however, an "anisotropic" stress state of a rock (200) may be modeled by considering multiple principal stresses (e.g., vertical stress $S_v$, maximum horizontal stress $S_H$, and minimum horizontal stress $S_h$) when defining effective stress. An anisotropic stress state of in situ rock (200) may be mimicked in a laboratory setting, which may also allow for the determination of mechanical and hydraulic rock properties, such as permeability K or diffusivity.

The pore pressure (513), $p_p$, may be determined as follows:

$$p(t, r) = \frac{\ln(2)}{t} \sum_{i=1}^{n} \left( c_i \frac{P_0 K_0\left(\sqrt{\frac{i\ln(2)}{tc}}\, r\right)}{\frac{i\ln, t(2)}{t} K_0\left(\sqrt{\frac{i\ln(2)}{tc}}\, a\right)} \right), \tag{2}$$

where p(t, r) is the pore pressure (513) in terms of time, t, at which the fracture opens and a radius, r, from a wellbore central axis, $P_0$ is the initial wellbore pressure at the start of injection, $K_0$ is the modified Bessel function of the second kind of order 0, a is the wellbore radius, and $c_i$ is determined as follows:

$$c_i = (-1)^{i+\frac{n}{2}} \sum_{k=\left\lfloor \frac{i+1}{2} \right\rfloor}^{\min\left(i,\frac{n}{2}\right)} \left( \frac{k^{\frac{n}{2}}(2k)!}{\left(\frac{n}{2}-k\right)!k!(k-1)!(i-k)!(2k-i)!} \right), \tag{3}$$

and c is determined as follows:

$$c = \frac{K}{\mu \phi c_f}, \tag{4}$$

where K is the rock permeability, μ is the injection fluid viscosity, ϕ is the rock porosity of the formation (103), and $c_f$ is the injection fluid compressibility, n is the number of alternating terms and includes a range between 6-20 in order to determine the pore pressure, p(t, r). In some embodiments, n may include a range between 6-10 to increase stability of computation. In some embodiments, K, may be a converging permeability prediction, $K_p$, such as described in relation to equation (20).

A poroelastic stress (514) may be determined as follows:

$$S_\theta^{(3)}(t, r) = \alpha\left(\frac{1-2\nu}{1-\nu}\right)\left(\frac{1}{r^2}\int_a^r p(t, \rho)\rho d\rho - p(t, r)\right), \tag{5}$$

where $$S_\theta^{(3)}$$

is the poroelastic stress (514) in terms of time, t, and the radius from a wellbore central axis, r, α is the Biot poroelastic parameter, ν is the Poisson ratio, a is the wellbore radius. In some embodiments, the composite Simpson's rule for numerical integration may be used. The poroelastic stress (514) is stress induced by the fluid permeation into the formation, such as fluid permeation during the injectivity test (153).

A breakdown pressure upper bound (420) is determined as follows:

$$P_{f-UpperBound} = \underset{0\le\theta\le\pi}{\text{Min}}\left[\frac{1}{(-\sigma_f-\sigma_z)}\left(\left(\frac{\sigma'_\theta-\sigma_z}{2}\right)^2+\sigma_{\theta z}^2-\left(\sigma_f+\frac{(\sigma'_\theta+\sigma_z)}{2}\right)^2\right)\right], \tag{6}$$

where in situ stress components $\sigma_\theta'$, $\sigma_z$, and $\sigma_{\theta z}$ in cylindrical coordinates are determined as follows:

$$\sigma'_\theta = \sigma_{xx} + \sigma_{yy} - 2(\sigma_{xx} - \sigma_{yy})\cos(2\theta) - 4\sigma_{xy}\sin(2\theta), \tag{7}$$

$$\sigma_z = \sigma_{zz} - 2\nu[(\sigma_{xx} - \sigma_{yy})\cos(2\theta) + 2\sigma_{xy}\sin(2\theta)], \tag{8}$$

$$\sigma_{\theta z} = 2(\sigma_{yz}\cos(\theta) - \sigma_{xz}\sin(\theta)), \tag{9}$$

where θ is the wellbore circumferential angle and the in situ stress components $\sigma_{xx}$, $\sigma_{yy}$, $\sigma_{zz}$, $\sigma_{xy}$, $\sigma_{yz}$, and $\sigma_{xz}$ are determined as follows:

$$\sigma_{xx} = S_H\cos^2(\alpha_b)\cos^2(\beta) + S_h\cos^2(\alpha_b)\sin^2(\beta) + S_v\sin^2(\alpha_b), \tag{10}$$

$$\sigma_{yy} = S_H\sin^2(\beta) + S_h\cos^2(\beta), \tag{11}$$

$$\sigma_{zz} = S_H\sin^2(\alpha_b)\cos^2(\beta) + S_h\sin^2(\alpha_b)\sin^2(\beta) + S_v\cos^2(\alpha_b), \tag{12}$$

$$\sigma_{xy} = -S_H\cos(\alpha_b)\cos(\beta)\sin(\beta) + S_h\cos(\alpha_b)\cos(\beta)\sin(\beta), \tag{13}$$

$$\sigma_{yz} = -S_H\sin(\alpha_b)\cos(\beta)\sin(\beta) + S_h\sin(\alpha_b)\cos(\beta)\sin(\beta), \tag{14}$$

$$\sigma_{xz} = S_H\cos(\alpha_b)\sin(\alpha_b)\cos^2(\beta) + S_h\cos(\alpha_b)\sin(\alpha_b)\sin^2(\beta) - S_v\cos(\alpha_b)\sin(\alpha_b), \tag{15}$$

where $S_H$ is the maximum horizontal stress, $S_h$ is the minimum horizontal stress, and $S_v$ is the overburden stress, $S_v$, $\alpha_b$ is the wellbore inclination from vertical axis, β is the wellbore azimuth relative to the $S_H$ direction as shown in FIG. 2 and FIG. 3. The breakdown pressure upper bound (420) may represent where the rock (200) is impermeable, for example, a dynamic dry bulk modulus of the rock (200) and the dynamic bulk modulus of the matrix mineral are the same, which implies that the Biot poroelastic parameter (α) is equal to zero and the breakdown pressure is only a function of the principal stresses, $S_H$, $S_h$, and $S_v$.

An effective stress correction (519) is determined for an open hole wellbore as follows:

$$P_{f-UpperBound} = P_{f-UpperBound} - \left(2 - \alpha\left(\frac{1-2\nu}{1-\nu}\right)\right)P_0, \tag{16}$$

or for a wellbore with a cemented liner as follows:

$$P_{f-UpperBound\ (corrected)} = P_{f-UpperBound} - \alpha P_0, \tag{17}$$

where α is the Biot poroelastic parameter and $P_0$ is the initial wellbore pressure.

The modeled breakdown pressure (425) is determined as follows:

$$P_f = P_{f-UpperBound} - S_\theta^{(3)}(t, r) - p(t, r), \tag{18}$$

In accordance with one of more embodiments, a breakdown pressure algorithm (531) may include equations (1)-(17) in order to determine the modeled breakdown pressure (425). Even though the equations are shown in a particular order, it will be apparent to a person having ordinary skill in the art that some of the equations in the breakdown pressure algorithm may be conducted in parallel, in a different order than shown, or may be omitted without departing from the scope of the invention.

In accordance with one or more embodiments, a permeability prediction (430) may be determined by using a permeability prediction algorithm (532). The permeability prediction (430) is the permeability that would be required to achieve the pressure of the breakdown pressure measurement (155). In some embodiments, the permeability prediction algorithm (532) may include a root-finding algorithm to converge on the permeability prediction (430).

In accordance with one or more embodiments, a damage comparison (520) is determined by comparing the breakdown pressure measurement (155) to the breakdown pressure upper bound (420) and the modeled breakdown pressure (425). If the breakdown pressure measurement (155) is greater than the breakdown pressure upper bound (420), a permeability damage (450) of the formation (103) is total, and the permeability prediction (430) is null as the formation is completely damaged. The well development plan (541) may include a remediation plan to remediate the permeability damage (450) of the formation (103). If the breakdown pressure measurement (155) is less than the modeled breakdown pressure (425) as determined by the breakdown pressure algorithm, then there is no permeability damage of the formation (103), and the permeability prediction (430) is approximately equal to the permeability well log data at each of the plurality of depths (107) where well log data was obtained. The well development plan (541) may include a stimulation plan for stimulating the wellbore (117). If the breakdown pressure measurement (155) is less than the breakdown pressure upper bound (420) and greater than the modeled breakdown pressure (425), then the permeability prediction (430) may be determined by finding a convergence of the permeability prediction algorithm (532) as described below.

In accordance with one or more embodiments, finding the root of a continuous function f within an interval (e.g., [a, b]) includes finding the interval of the function in terms of (a) (i.e., f(a)) that changes signs from the function in terms of (b) (i.e., f(b)) so the function converges to 0 within a tolerance. For example, the root-finding algorithm may be a bisection method algorithm. The bisection method algorithm divides an initial interval in half and selects an interval half that includes a 0 (i.e., f(c)=0) where c is contained in the interval half. An objective function F may be defined as follows:

$$F(K) = P_{MB} - P_f(K), \tag{19}$$

where $P_{MB}$ is the breakdown pressure measurement (155), $P_f$ is the modeled breakdown pressure (425) as determined by the breakdown pressure algorithm and if the interval is defined as $[K_a, K_b]$ being interval endpoints, where initially $K_a=0$ and $K_b=K$, where K is a converging permeability prediction at each of the plurality of depths (107) where the permeability prediction algorithm (532) was applied. The root of the objective function F may converge to 0 within the tolerance and the interval $[K_a, K_b]$ may converge on the permeability prediction (430) with each iteration as described below. The converging permeability prediction may be defined as follows:

$$K_p = K_a + \frac{K_b - K_a}{2}, \tag{20}$$

where $K_p$ is the converging permeability prediction. If $F(K_p)$ is greater than the tolerance, $K_p$ is input to the breakdown pressure algorithm as K in Eq. (3). The modeled breakdown pressure (425) is re-determined by the breakdown pressure algorithm, the interval is redefined on interval half endpoints, updated $[K_a, K_b]$ where the interval half contains a 0, for example the sign changes between $F(K_a)$ and $F(K_b)$ where $K_a$ and $K_b$ have been updated to be the interval endpoints. The converging permeability prediction ($K_p$) is redetermined on the new interval defined by the interval half endpoints. $F(K_p)$ is re-compared to the tolerance and the algorithm iterates until $F(K_p)$ is less than the tolerance. If the $F(K_p)$ is less than the tolerance, then the permeability prediction (430), $K_{predicted}$, is equivalent to the converging permeability prediction($K_p$) of the current iteration. The permeability prediction (430) may represent the permeability at each of the plurality of depths (107) if there were no permeability damage of the formation (103) from operations such as drilling.

In some embodiments, the permeability damage (450) of the formation (103) is determined by taking the difference of the permeability prediction (430) from the permeability well log data. The permeability damage (450) may represent the damage that occurred during drilling operations such as drilling mud infiltrating the pores (204) of the rock (200) adjacent to the wellbore (117).

In some embodiments, a convergence analysis (522) may be used to ensure convergence of the permeability prediction algorithm (532). The convergence analysis (522) may ensure that the permeability prediction algorithm (532) (e.g., the root-finding algorithm) will always converge to a unique solution. The convergence analysis (522) may ensure the permeability prediction algorithm (532) provides an accurate solution. The convergence analysis (522) may show that the permeability prediction algorithm (532) will result in a sequence of the converging permeability predictions converge to the permeability prediction (430) that includes a unique permeability value. For example, the convergence analysis (522) for the case where:

$$P_f(k) < P_{MB} < P_{f-UpperBound}, \tag{21}$$

shows that the objective function is continuous over the interval $[K_a, K_b]$ and that $F(0)<0$ in the above equation (19).

FIG. 3 shows a portion of the wellbore (117). The subsurface (122) may include a coordinate system (300) such as a Cartesian coordinate system or a cylindrical coordinate system. The coordinate system (300) may include one or more spatial dimensions. In accordance with one or more embodiments, the wellbore (117) may be represented within the coordinate system by the one or more spatial dimensions. For example, in the Cartesian coordinate system, the one or more spatial dimensions may include an X axis (302), a Y axis (303), and a Z axis (301) such that each of the plurality of depths (107) of the wellbore (117) may be represented within the subsurface (122) with a spatial coordinate of (X, Y, Z). The spatial coordinate (X, Y, Z) may be transformed by applying a spatial transformation from Cartesian coordinate system to a rotated coordinate system to determine, for example, the X axis (302), the Y axis (303), and the Z axis (301) may be rotated to become the z' axis (350), a y' axis (351), and the x' axis (352). Alternatively, for example, in the cylindrical coordinate system, the one or more spatial dimensions may include a radius (310), r, the wellbore circumferential angle (312), θ, and a z' coordinate on the z' axis (350). The z' may be aligned with a wellbore central axis (360) and may be representative of the plurality of depths (107). The radius (310), r, may be based on a distance from the wellbore central axis (360). In some embodiments, the subsurface (122) may be digitally represented by a computational grid that is determined by the coordinate system in order to determine the permeability prediction (430) along the wellbore (117) and/or a distance away from the wellbore (117). The computational grid may either be two-dimensional ("2D") or three-dimensional ("3D") and segmented into 2D or 3D grid cells.

In some embodiments, the X axis (302), the Y axis (303), and the Z axis (301) may be rotated to be aligned with an overburden stress (306), $S_v$, and two horizontal stresses, minimum horizontal stress (308), $S_h$, and maximum horizontal stress (307), $S_H$. The wellbore geometry may be defined by the wellbore inclination (314), $\alpha_b$, which may be determined from a vertical axis such as the Z axis (301), and the wellbore azimuth (311), $\beta$, which may be determined relative to the direction of the maximum horizontal stress (307), $S_H$.

Figure 4A:
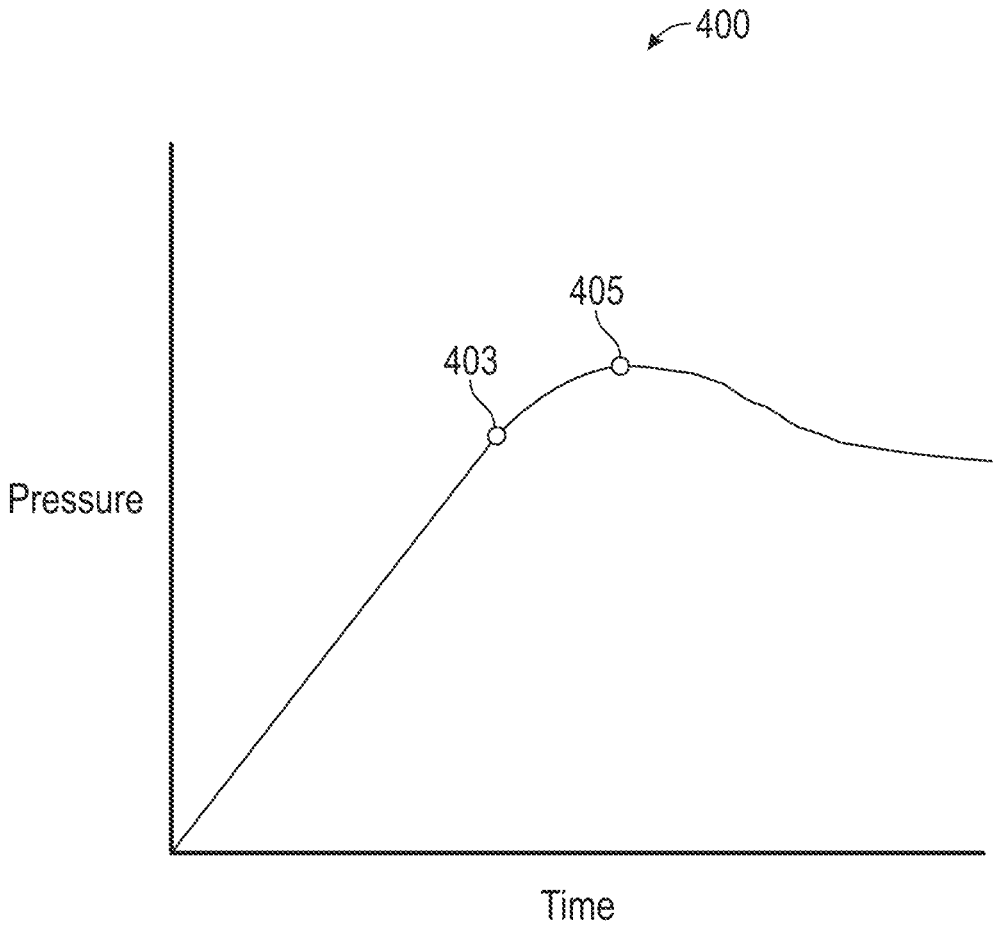
FIG. 4A depicts example results of an injectivity test performed in relation to one or more embodiments.

FIG. 4A illustrates an example injectivity test result (400) performed in relation to one or more embodiments. For example, injection fluid, using the injectivity test assembly (121), may be injected into the portion of the wellbore (117) that is newly drilled after a previous section of the wellbore (117) has been cased and cemented. The annulus of the wellbore between the drillstring (106) and the wellbore wall (109) may be sealed by rams of the BOP or the one or more packers (125) within the wellbore (117). The injection fluid may be pumped at a constant rate thereby increasing the pressure at a linear rate. As the formation begins to fracture, a leak-off point (403) has been reached where the injection fluid is seeping into the formation. As the pressure is further increased, the formation breakdown pressure (405) is reached where the formation has fractured completely, and the injection fluid is flowing into the fractures and pore spaces of the formation. The breakdown pressure measurement (155) is determined from the formation breakdown pressure (405) reached during the injectivity test (153).

Figure 4B:
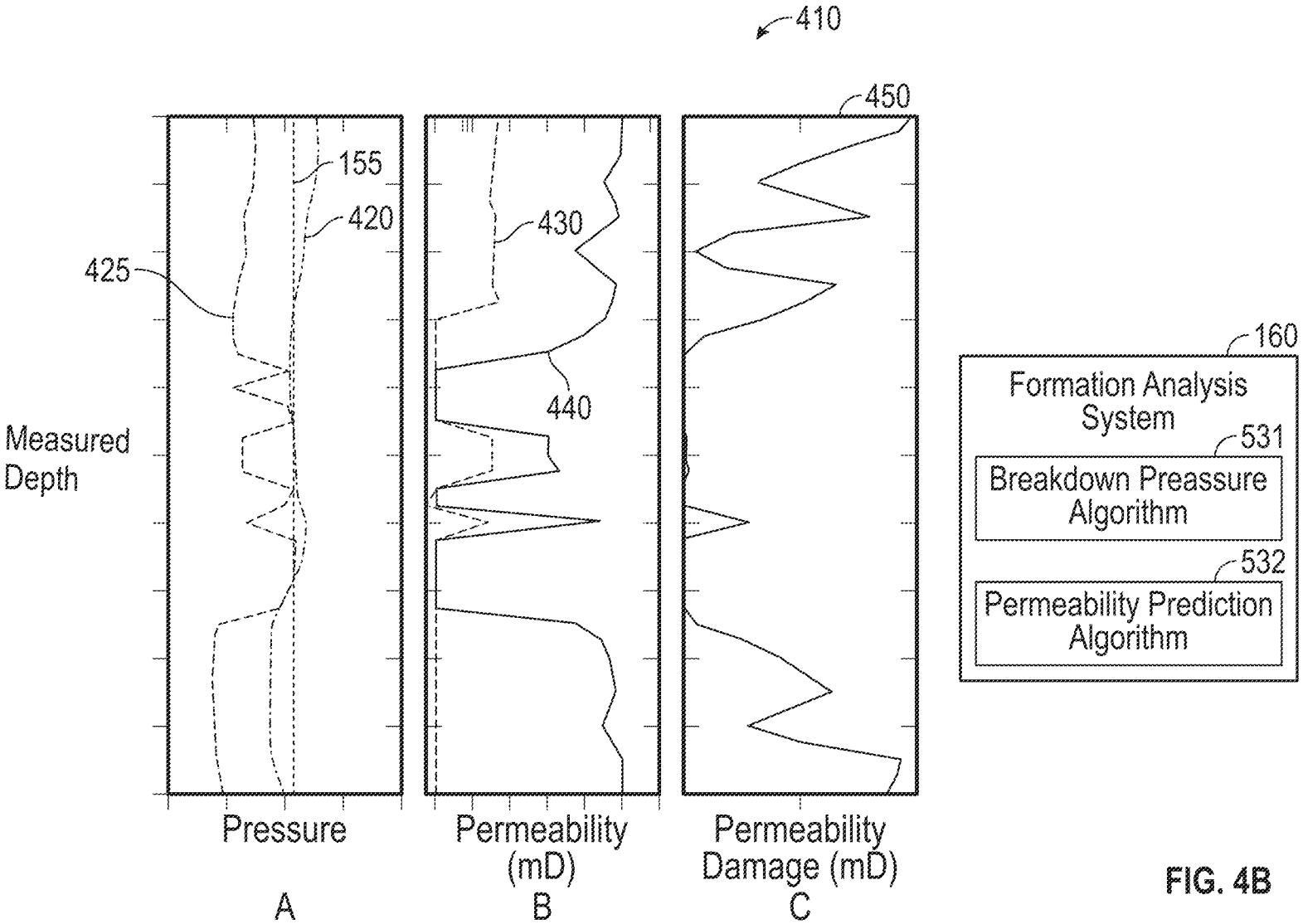
FIG. 4B depicts an example well log plot that may be generated by a formation property acquisition system in accordance with one or more embodiments.

FIG. 4B illustrates an example well log plot (A-C) (410) of a result of a breakdown pressure algorithm (531) and the permeability prediction algorithm (532) showing the one or more well logs (145) that may be generated by the formation property acquisition systems (501) in accordance with one or more embodiments. Well log plot A depicts a breakdown pressure measurement (155) obtained by the injectivity test assembly (121). The well log plot A also depicts the breakdown pressure upper bound (420) based on the poroelastic stress (514), $$S_\theta^{(3)},$$

the tensile strength, $\sigma_f$, or a rock (200), and/or the in situ stress components. The well log plot A also depicts the modeled breakdown pressure (425) based on the breakdown pressure upper bound (420), the pore pressure (513), $P_p$, and/or the poroelastic stress, $$S_\theta^{(3)}$$

using the breakdown pressure algorithm (531). Locations where the modeled breakdown pressure (425) is approximately equal to the breakdown pressure measurement (155) show where the permeability of the formation may not have been damaged. Locations where the modeled breakdown pressure (425) is less than the breakdown pressure measurement (155) shows where the permeability of the formation has been damaged and where the well remediation operations may need to be targeted to repair the damage of the permeability of the formation (103). Well log plot B shows the permeability prediction (430) of the permeability prediction algorithm (532) and a permeability well log (440) obtained over the depth interval (131) in accordance with one or more embodiments. Well log plot C shows the permeability damage (450) of the formation (103) quantified demonstrating where the damage of the permeability of the formation may have occurred and the depth interval(s) (131) to target for well remediation operations. The permeability damage (450) may be obtained by taking the difference of the permeability prediction (430) and the permeability well log (440).

Figure 5A:
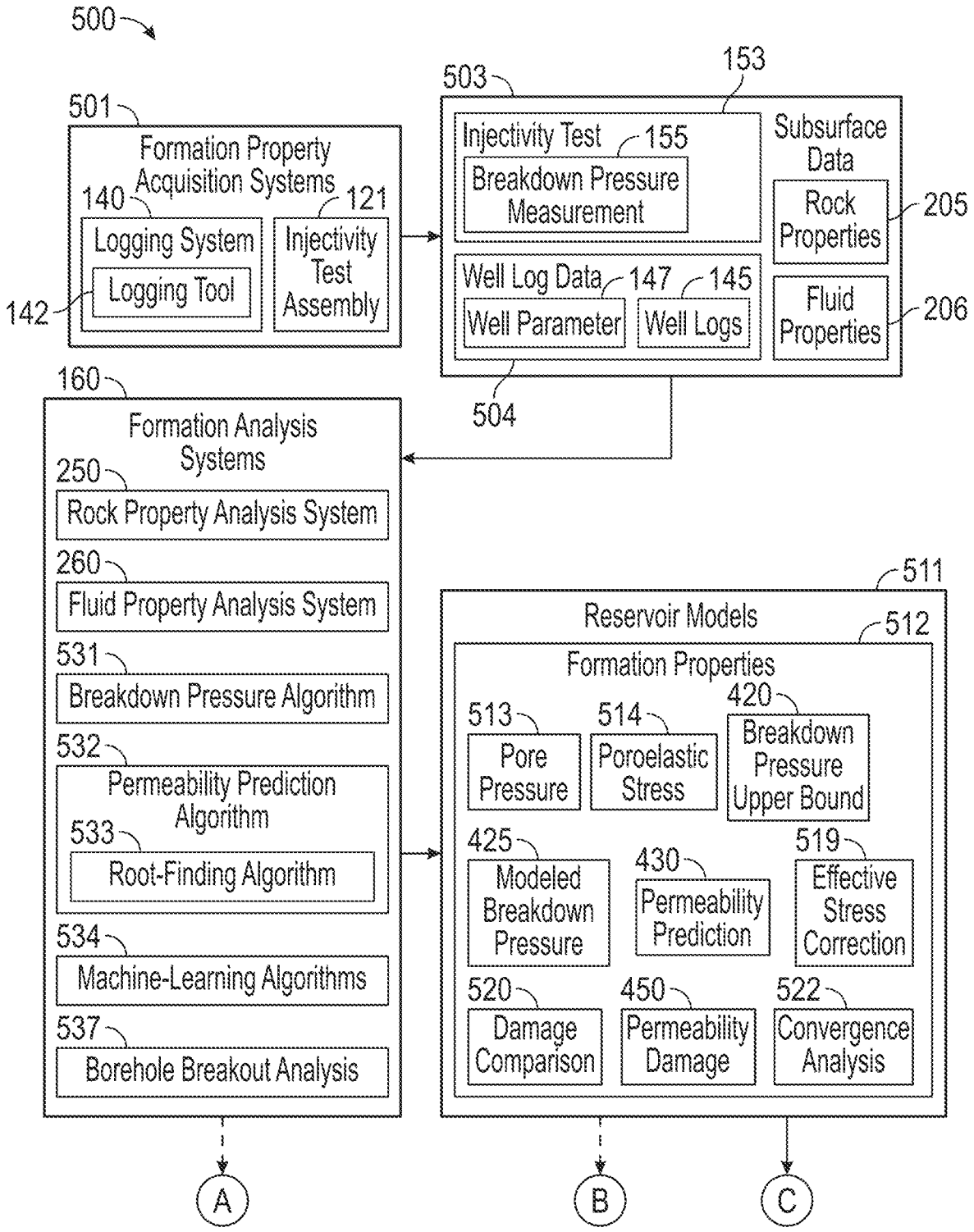
FIGS. 5A-5B depict a formation permeability estimation workflow in accordance with one or more embodiments.
Figure 5B:
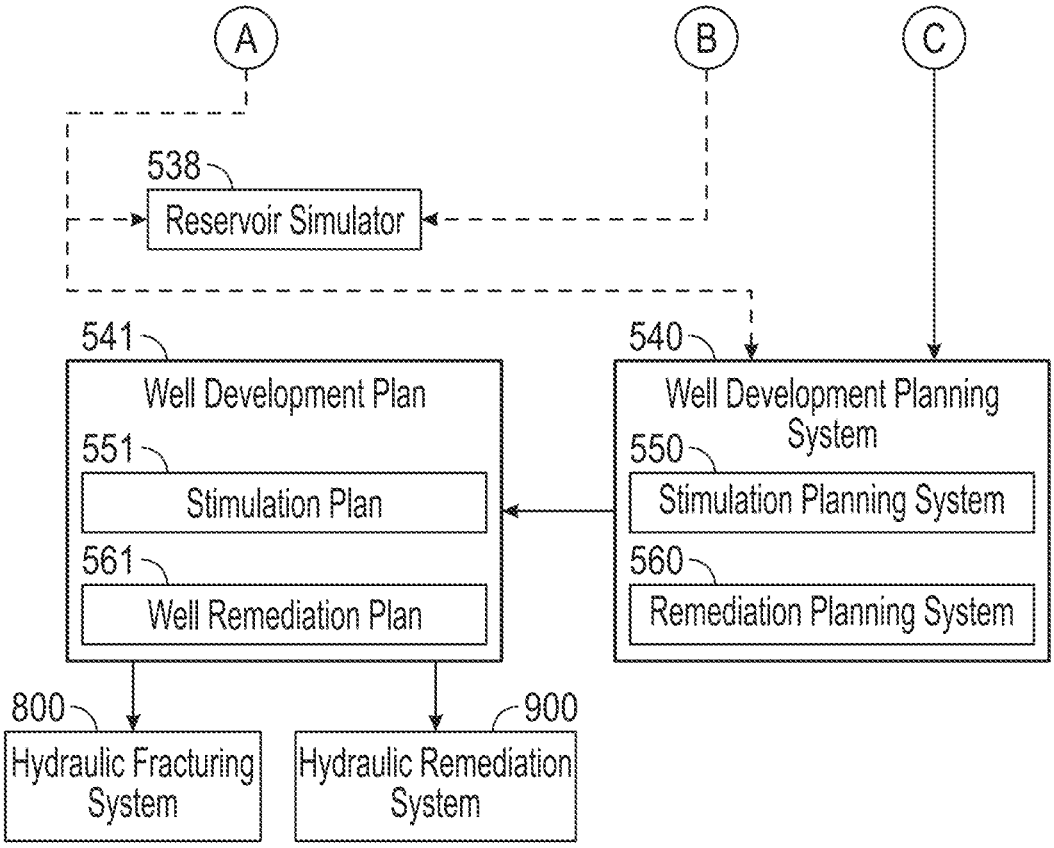

FIG. 5A and FIG. 5B illustrate a formation permeability estimation workflow (500) in accordance with one or more embodiments. The workflow includes steps of acquiring subsurface data (503), determining one or more formation properties (512), determining the modeled breakdown pressure (425), the permeability prediction (430), and the permeability damage (450), and planning of stimulation and well remediation operations. Although the steps in flowchart using the workflow are shown in sequential order, it will be apparent to one of ordinary skill in the art that some steps may be conducted in parallel, in a different order than shown, or may be omitted without departing form the scope of the invention.

For example, the formation permeability estimation workflow (500) may begin with the use of the one or more formation property acquisition systems (501) (e.g., the logging system (140) and the injectivity test assembly (121)). The injectivity test assembly (121) may be used to acquire the breakdown pressure measurement (155). The logging system (140) is used to acquire well log data (504) and the well parameter (147). The formation property acquisition systems (501) may also include other remote sensing acquisition systems such as a seismic data acquisition system configured to acquire seismic data from a geographical region that includes the well (100). Other remote sensing data may also be collected at this stage to characterize the subsurface (122). For example, resistivity, transient electromagnetic, and/or gravitation surveys may be collected.

In some embodiments, the subsurface data (503) includes the well log data (504), pressure data including the breakdown pressure measurement (155), the seismic data, or a combination thereof. The well log data (504) may be in an unprocessed "raw" form that may be used to determine the one or more formation properties (512).

In some embodiments, the subsurface data (503) may include a wide variety of noise and distortion which in their unprocessed "raw" form may not provide significant useful information about the subsurface (122). Consequently, in such embodiments the subsurface data (503) may be processed, using a formation analysis system (160), to remove or attenuate noise and to correctly process the subsurface data (503). Processing of the subsurface data (503) may be performed by a number of methods known to a person of ordinary skill in the art without departing from the scope of the invention. For example, processing well logs (145) may include depth matching (i.e., aligning) the distinct logging runs. Depth matching includes aligning portions of the similar types of logs from different logging runs and which overlap in depth so that the logs are corrected for any depth errors between each logging run that may occur. Depth error may include cable stretching, tool sticking, tool slipping, and/or yo-yo effects among other issues that affect depth control of the one or more logging tools (142). Other processing may include de-spiking. De-spiking may include removing any data point that falls outside of a given threshold. The thresholds may be input from a user on a user device. The user device may be connected wirelessly or via cable to the formation analysis system (160).

Another result of processing the subsurface data (503) with the formation analysis system (160) may be one or more subsurface images and/or attributes using the subsurface data (503) obtained with the one or more logging tools (142), the wellbore imaging tools (e.g., optical imaging tools, electrical imaging tools, acoustic imaging tools), the seismic data acquisition system, or in combinations thereof. The formation analysis system (160) may be configured to determine the subsurface image and attributes of the subsurface (122) based on the subsurface data (503). The subsurface image and/or attributes may be a 2D or 3D image of the points within the subsurface (122) that generates a distinctive subsurface response. For example, the subsurface image may display the points at which acoustic energy is reflected, or scattered, within the subsurface (122) such as with the acoustic logging data. Other characteristics or "attributes" of the subsurface (122) may be displayed as the subsurface image and attributes. For example, the strength of conversion of energy from one type of source wave to another as in acoustic imaging of the subsurface (122), or the strength of absorption of source energy, or the velocity of source propagation may be displayed as a function of subsurface position in the subsurface image and attributes. The examples of attributes given above are purely illustrative, and a person having ordinary skill in the art will appreciate that anyone of dozens of other attributes may be displayed as the subsurface image and the examples described should not be interpreted as limiting the scope of the invention in any way.

Figure 7:
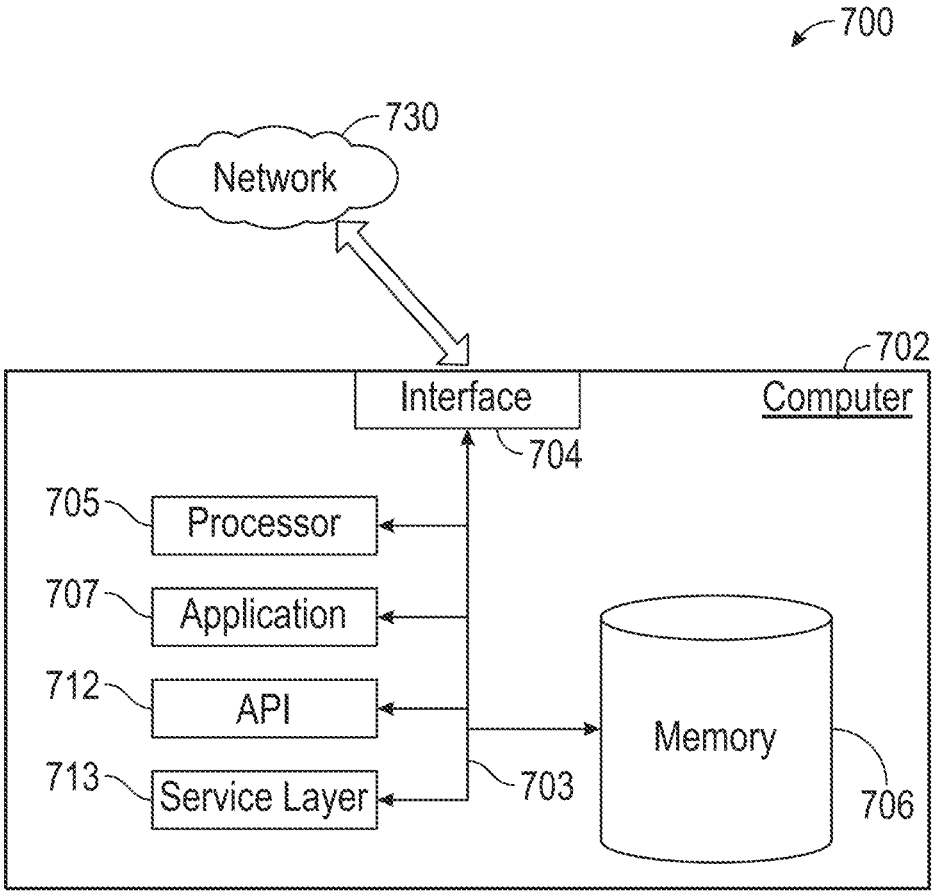
FIG. 7 depicts a computer system that may be used in relation to various embodiments.

The formation analysis system (160) may include a computer system, such as the computer system (700) shown in FIG. 7. The formation analysis system (160) will typically be configured with appropriate subsurface data processing and analysis software and augmented with a number of purpose specific elements, such as high-capacity tape drives or hard drives connected through high-speed buses to computer processing units ("CPUs"). Further the CPUs of the formation analysis system (160) will typically be connected to a plurality of graphical processing units ("GPUs") that perform many of the computationally intensive operations on the subsurface data (503), banks of high-speed tape, or hard-drive, readers to read the data from storage, high-speed tape or hard-drive writers to output final or intermediate results, and high-speed communication buses to connect these elements.

It will be appreciated by a person having ordinary skill in the art that the subsurface data (503) are extremely large, typically occupying hundreds of Gigabytes to Terabytes of data samples and cannot be manipulated or "processed" without the assistance of the formation analysis system (160) purposely configured to handle the subsurface data (503). Based upon the disclosure provided herein, one of ordinary skill in the art will appreciate that the gathering of the data involves specialized tools to obtain the vast quantities of gathered data, and high-speed processing capability capable of performing at least one thousand calculations per second. Indeed, in some embodiments, processors capable of millions, billions, or even more calculations per second are used.

The subsurface images and attributes may be an image, typically composed of pixels of varying intensity, and is not itself a model of the geological structure of the subsurface (122) to which it pertains. To determine the geological structure corresponding to, or that produced, the subsurface image is typically "interpreted" using the formation analysis system (160).

The formation analysis system (160) may include a subsurface interpretation workstation. The subsurface interpretation workstation is primarily used by subsurface interpreters (e.g., geoscientists, reservoir engineers, and petrophysicists) and development teams in the oil and gas industry for analyzing the subsurface data (503) to understand geologic structures, and characteristics of the subsurface (122). Subsurface interpreters use the subsurface interpretation workstation to visualize the subsurface data (503), including, but not limited to, the well log data (504) including the pressure data from the injectivity test (153), the seismic data such as 2D or 3D seismic volumes, well and seismic cross-sections, imaging attribute maps, and imaging attribute plots. These visualizations provide insights into subsurface structures, faults, and potential hydrocarbon reservoir formations and hydrocarbon source formations. Additional data may be used within the subsurface interpretation workstation to facilitate the interpretation of the subsurface data (503). Such data may also include other remote sensing data such as seismic, resistivity, transient electromagnetic, and/or gravitational surveys.

Subsurface interpreters may pick and interpret key geologic boundaries (180) within the well log data (504) to identify stratigraphic layers, properties, and structural features. Subsurface interpretation tools and workflows allow for the accurate extraction of geological information from the subsurface data (503). For example, the formation analysis system (160) enables interpreters to identify features and characteristics that may impact the formation (103) and the production of hydrocarbons. Subsurface attributes provide additional information about subsurface properties and can be analyzed using various algorithms and statistical methods such as fluid flow and production scenarios.

The formation analysis system (160) may be used to determine the reservoir production potential, where subsurface interpreters may identify and assess areas with production potential. The subsurface interpreters may perform detailed geological, petrophysical, completions, and reservoir engineering analysis, identify production and stimulation targets, and quantify production rates and uncertainties associated with reservoir exploitation.

Subsurface interpretation involves working with large and complex data sets. Multiple high-resolution monitors allow interpreters to view the subsurface data (503), cross-sections, attribute maps and plots, and other visualizations simultaneously, enhancing productivity and analysis accuracy. The subsurface interpretation workstation may be equipped with industry-standard software applications tailored for subsurface interpretation, such as petrophysical, seismic and/or VSP data processing and visualization tools, well logs and petrophysics interpretation systems, attribute analysis software, and 3D modeling software.

Subsurface processing and interpretation projects generate substantial amounts of data, including petrophysical interpretations of the well logs (145), seismic volumes, processed data such as the one or more subsurface images and attributes formed from the seismic data, velocity models, the well log data (504), and interpretation results such as subsurface interpretations and reservoir models. A high-capacity and fast storage system, such as solid-state drives (SSDs) or RAID arrays, is necessary to store and access this data efficiently. The formation analysis system (160) often requires network connectivity to access centralized data repositories, collaborate with colleagues, and share interpretation results. A robust network infrastructure with fast Ethernet or fiber connections ensures smooth data transfer and collaboration capabilities. The formation analysis system (160) may be configured to identify drilling targets based, at least in part, on the subsurface image and attributes.

Essential peripherals like keyboards, mice, and graphics tablets enable efficient interaction with data and software interfaces. The formation analysis system (160) may be augmented with purpose specific peripherals such as high capability display devices that may include immersive or virtual reality devices, such as virtual-reality headsets or immersive "caves". Additionally, color-calibrated, and high-accuracy input devices enhance the precision of interpretation tasks like picking horizons representing stratigraphy or drawing geological features. The formation analysis system (160) should have backup solutions in place to protect valuable data from loss or damage. Automated backup systems, external storage devices, or network-attached storage (NAS) can be utilized to ensure data safety. In some cases, subsurface interpreters may need remote access to the formation analysis system (160) or collaborate with colleagues remotely. Setting up remote access capabilities, such as Virtual Private Networks (VPNs) or remote desktop solutions, allows interpreters to work from different locations and share their work effectively. The formation analysis system (160) may be customized to meet the needs of interpreters and the specific requirements of projects. The hardware specifications may vary based on factors like the complexity of interpretations, the size of data sets, and the software tools utilized.

In some embodiments, the formation analysis system (160) may be configured to determine, using the breakdown pressure algorithm (531), and to determine the permeability prediction (430), using the permeability prediction algorithm (532) as described in relation to FIG. 2. The formation analysis system (160) may be configured to determine the principal stresses such as the vertical stress, $S_v$, the maximum horizontal stress, $S_H$, and the minimum horizontal stresses, $S_h$, based on the well log data (504) such as the pressure data, the caliper well data, and/or the sonic well log. In some embodiments, a borehole breakout analysis (537) may be used to determine the minimum horizontal stress, $S_h$, as described in relation to FIG. 2. Determining the vertical stress, $S_v$, the maximum horizontal stress, $S_H$, and the minimum horizontal stresses, $S_h$, may be performed by a number of methods known to a person of ordinary skill in the art without departing from the scope of the invention. The principal stresses may be used to determine the in situ stress components within the coordinate system (300) such as either the Cartesian coordinate system or cylindrical coordinate system as described in relation to FIG. 2. In the context of this disclosure, equations (1)-(20) are derived in a cylindrical coordinate system. The coordinate system may be rotated so that the r-axis may be aligned with the orientation of the maximum horizontal stress, $S_H$.

In some embodiments, the one or more formation properties (512) may be determined using the formation analysis system (160) and as described in relation to FIG. 2. The one or more formation properties (512) may be determined at one of the plurality of depths (107) or at each of the plurality of depths within the depth interval (131) that well log data (504) was obtained. It will be apparent to a person having ordinary skill in the art that the one or more formation properties (512) may be determined at multiple depths without departing from the scope of this disclosure.

In accordance with one or more embodiment, the one or more formation properties (512) using the breakdown pressure algorithm (531) and the permeability prediction algorithm (532) as described in relation to FIG. 2. The formation analysis system (160) is configured to determine the pore pressure (513) based on the injection fluid properties, the well parameter (147) and/or the well log data (504). The injection fluid properties may include fluid compressibility, $c_f$, and/or the injection fluid viscosity, $\mu$. The well parameter (147) may include the wellbore initial pressure, $P_0$, the wellbore radius (313), a, the wellbore inclination (314), $\alpha_b$, and/or the wellbore circumferential angle (312), $\theta$. The formation analysis system (160) is configured to determine the poroelastic stress (514) based on the pore pressure (513), the well parameter (147), and/or the rock properties (205) such as the Biot poroelastic parameter and the Poisson Ratio. The formation analysis system (160) is configured to determine the breakdown pressure upper bound (420) based on the poroelastic stress (514), the tensile strength, $\sigma_f$, of a rock (200), and/or the in situ stress components. The formation analysis system (160) is configured to determine the modeled breakdown pressure (425) based on the breakdown pressure upper bound (420), the pore pressure (513), and/or the poroelastic stress (514). The formation analysis system (160) is configured to determine, using a root-finding algorithm (533), the permeability prediction (430) based on the modeled breakdown pressure (425).

In some embodiments, the formation analysis system (160) may be configured to apply the effective stress correction (519) based on the status of the wellbore (e.g., open hole or cased and cemented) as described in relation to FIG. 2 and on the one or more rock properties (205). The effective stress correction (519) may be applied to the breakdown pressure upper bound (420).

In some embodiments, the formation analysis system (160) may be configured to compare the breakdown pressure measurement (155) to the breakdown pressure upper bound (420) to yield the damage comparison (520). The formation analysis system (160) may be configured to determine the permeability damage (450) along the well (100) based on the damage comparison (520) as described in relation to FIG. 2. In some embodiments, the formation analysis system (160) is configured to determine whether the breakdown pressure measurement (155) is greater than the breakdown pressure upper bound (420). The well development planning system (540) is configured to continue normal well operations if the breakdown pressure measurement (155) is less than the breakdown pressure upper bound (420) rather than implement a well remediation plan (561).

In some embodiments, the formation analysis system (160) may be configured to apply the convergence analysis (522) to establish a linear convergence of the permeability prediction (430) as described in relation to FIG. 2. The formation analysis system (160) may be configured to apply the convergence analysis (522) to show that the permeability prediction algorithm (532) will result in a sequence of the converging permeability prediction that converges to the permeability prediction (430) that includes a unique permeability value.

The result of interpreting the subsurface data (503) such as the well log data (504), pressure data, the one or more rock properties (205), and/or the one or more fluid properties (206) may be one or more reservoir models (511) of the subsurface (122). The reservoir model (511) may include utilizing the subsurface interpretation of the geologic boundaries (180) and the formation properties (512). The reservoir model (511) may include the locations of geologic boundaries (180), the different rock types ("facies"), and faults and fractures. The reservoir model (511) may also include descriptions of the characteristics of different facies including rock properties (205) such as porosity and permeability, and the relative amounts of different fluids, such as hydrocarbons, and brine, within the pores (204) in each facies. The porosity and permeability may be used to define the reservoir formation quality for example. The formation analysis system (160) may include system software tools configured to populate the reservoir models (511) such as using variograms and other statistical tools.

In some embodiments, the reservoir models (511) may include the one or more formation properties (512), and inputs from the subsurface data (503) such as the well log data (504) and the breakdown pressure measurement (155). The reservoir model (511) may include a digital description of the physical properties of the rocks, such as the one or more rock properties (205), and the fluids, such as the one or more fluid properties (206). The reservoir simulator (538) may use the reservoir models (511) as a function of position within the reservoir (105) and the formation fluids within the pores (204) of the porous, permeable reservoir rocks at a given time. In some embodiments, the digital description may be in the form of a dense 2D and/or 3D model grid with the physical properties of rocks and fluids defined at each node. In some embodiments, the 3D model grid may be a cartesian grid, while in other embodiments the model grid may be an irregular grid.

Reservoir simulators (538) solve a set of mathematical governing equations that represent the physical laws that govern fluid flow in porous, permeable media. For example, the flow of a fluid with a constant viscosity and compressibility the equations capture Darcy's law, the continuity condition, and the equation of state.

Additional, and more complicated equations are required when more than one fluid, or more than one phase, e.g., liquid and gas, are present in the reservoir (105). Further, when the physical and petrophysical properties of the rocks and fluids vary as a function of position the governing equations may not be solved analytically and must instead be discretized into a grid of cells or blocks. The governing equations must then be solved by one of a variety of numerical methods, such as, without limitation, explicit or implicit finite-difference methods, explicit or implicit finite element methods, or discrete Galerkin methods.

In some embodiments, the reservoir models (511) may be input to a reservoir simulator (538). A reservoir simulator (538) comprises functionality for simulating the flow of fluids, including the production fluid, through the porous, permeable reservoir (105) in response to natural and anthropogenic pressure gradients. The reservoir simulator (538) may be used to predict changes in fluid flow, including fluid flow into a well penetrating the reservoir (105) as a result of planned well drilling, fluid injection and extraction, and stimulation of the reservoir (105). For example, the reservoir simulator (538) may be used to predict fluid flow and production scenarios including changes in hydrocarbon production rate that would result from the stimulation of the reservoir (105) based on the formation properties (512).

The reservoir models (511) may be based on the subsurface data (503) and may include identifying the reservoir (105), seal, among other features (e.g., the fluid properties (206) and the rock properties (205)). For example, data sets from acquiring remote sensing geophysical surveys, such as seismic surveys, gravity surveys, and active and passive source resistivity surveys, may be employed. In addition, data collected from the well logs (145) acquired in the well (100) penetrating the reservoir (105) may be used to determine physical and petrophysical properties along the segment of the well trajectory traversing the reservoir (105) and/or the source formation. For example, porosity, permeability, density, sonic velocity, and resistivity may be measured along these segments of the wellbore (117). In accordance with some embodiments, remote sensing geophysical surveys and physical and petrophysical properties determined from the well log data (504) may be combined to estimate physical and petrophysical properties for the entire reservoir simulation model grid.

In some embodiments, the reservoir models (511) may be used to create the well development plan (541) using the well development planning system (540) configured to determine the well development plan (541) based on the one or more formation properties (512) such as the permeability prediction (430) and/or the permeability damage (450). The well development plan (541) may include potential hydrocarbon production rates from the well (100) based on the reservoir models characterization of the subsurface (122). The well development plan (541) may include a stimulation plan (551) for the well (100). The well development planning system (540) may include a stimulation planning system (550) known in the art. The stimulation planning system may be configured to design the stimulation plan (551) based on the one or more formation properties (512) (e.g., the permeability prediction (430) and/or the permeability damage (450)). The stimulation planning system (550) may include a computer system that is the same or similar to the computer system (700) as described in relation to FIG. 7. The stimulation planning system (550) may include stimulation planning specific software configured for designing the stimulation plan (551). The stimulation plan (551) may include stimulating the formation (e.g., the reservoir (105) using a hydraulic fracturing system configured to stimulate the formation based on the stimulation plan (551). The hydraulic fracturing system may be the same or similar to a hydraulic fracturing system (800) as described in relation to FIG. 8.

In some embodiments, the well development planning system (540) may include any remediation planning system (560) known in the art. configured to design a well remediation plan (561) based on the one or more formation properties (512) (e.g., the permeability prediction (430) and/or the permeability damage (450) to remediate any damage (e.g., permeability damage (450)) to the formation (103) surrounding the wellbore (117) due to well operations such as drilling operations. The well remediation plan (561) may include performing, using a well remediation system, well remediation operations on the formation surrounding the wellbore (117) in order to potentially increase hydrocarbon production rates. The well remediation system is configured to perform well remediation operations on the wellbore (117) based on the well remediation plan (561). The well remediation system (900) may be the same or similar to a well remediation system as described in FIG. 9. Well remediation operations may include acid treatments to repair the permeability damage (450) caused from drilling operations.

In accordance with one or more embodiments, the formation analysis system (160) may include hardware and/or software with functionality for generating and/or updating one or more machine-learning models using one or more machine learning algorithms (534) to determine the permeability prediction (430), the permeability damage (450), the formation properties (512), the reservoir models (511), and/or designing the well development plan (541). Examples of machine-learning algorithms (534) may include random forest algorithms and artificial neural networks, such as convolutional neural networks, deep neural networks, and recurrent neural networks. Machine-learning algorithms (534) may also include, but not limited to, support vector machines, decision trees, inductive learning models, deductive learning models, supervised learning models, unsupervised learning models, reinforcement learning models, etc.

In some embodiments, determining the permeability prediction (430), the permeability damage (450), the formation properties (512), the reservoir models (511) and/or the well development plan (541) may include using artificial neural networks such as deep neural networks. In a deep neural network, for example, a layer of neurons may be trained on a predetermined list of features based on the previous network layer's output. Thus, as data progresses through the deep neural network, more complex features may be identified within the data by neurons in later layers. Likewise, a U-net model or other type of convolutional neural network model may include various convolutional layers, pooling layers, fully connected layers, and/or normalization layers to produce a particular type of output. Thus, convolution and pooling functions may be the activation functions within a convolutional neural network. In some embodiments, two or more different types of machine-learning models are integrated into a single machine-learning architecture, e.g., a machine-learning model may include K-nearest neighbor (k-NN) models and neural networks. In some embodiments, the formation analysis system (160) and/or the reservoir simulator (538) may generate augmented data or synthetic data to produce a large amount of interpreted data for training a particular model.

In some embodiments, various types of machine-learning algorithms (534) may be used to train the machine-learning models, such as a backpropagation algorithm. In a backpropagation algorithm, gradients are computed for each hidden layer of a neural network in reverse from the layer closest to the output layer proceeding to the layer closest to the input layer. As such, a gradient may be calculated using the transpose of the weights of a respective hidden layer based on an error function (also called a "loss function"). The error function may be based on various criteria, such as mean squared error function, a similarity function, etc., where the error function may be used as a feedback mechanism for tuning weights in the machine-learning models.

In some embodiments, machine-learning models may be trained using multiple epochs. For example, an epoch may be an iteration of a model through a portion or all of a training dataset. As such, a single machine-learning epoch may correspond to a specific batch of training data, where the training data is divided into multiple batches for multiple epochs. Thus, machine-learning models may be trained iteratively using epochs until the model achieves a predetermined criterion, such as predetermined level of prediction accuracy or training over a specific number of machine-learning epochs or iterations. Thus, better training of a model may lead to better predictions by a trained model.

In some embodiments, the formation analysis system (160) and/or the reservoir simulator (538) uses one or more machine-learning methods to produce a hybrid-model architecture. For example, an ensemble learning method may use multiple types of machine-learning models to obtain better predictive performance than available with a single machine-learning model. In some embodiments, for example, an ensemble architecture may combine multiple base models to produce a single machine-learning model. One example of an ensemble learning method is a BAGGing model (i.e., BAGGing refers to a model that performs Bootstrapping and Aggregation operations) that combines predictions from multiple neural networks to add a bias that reduces variance of a single trained neural network model. Another ensemble learning method includes a stacking method, which may involve fitting many different model types on the same data and using another machine-learning model to combine various predictions.

Figure 6:
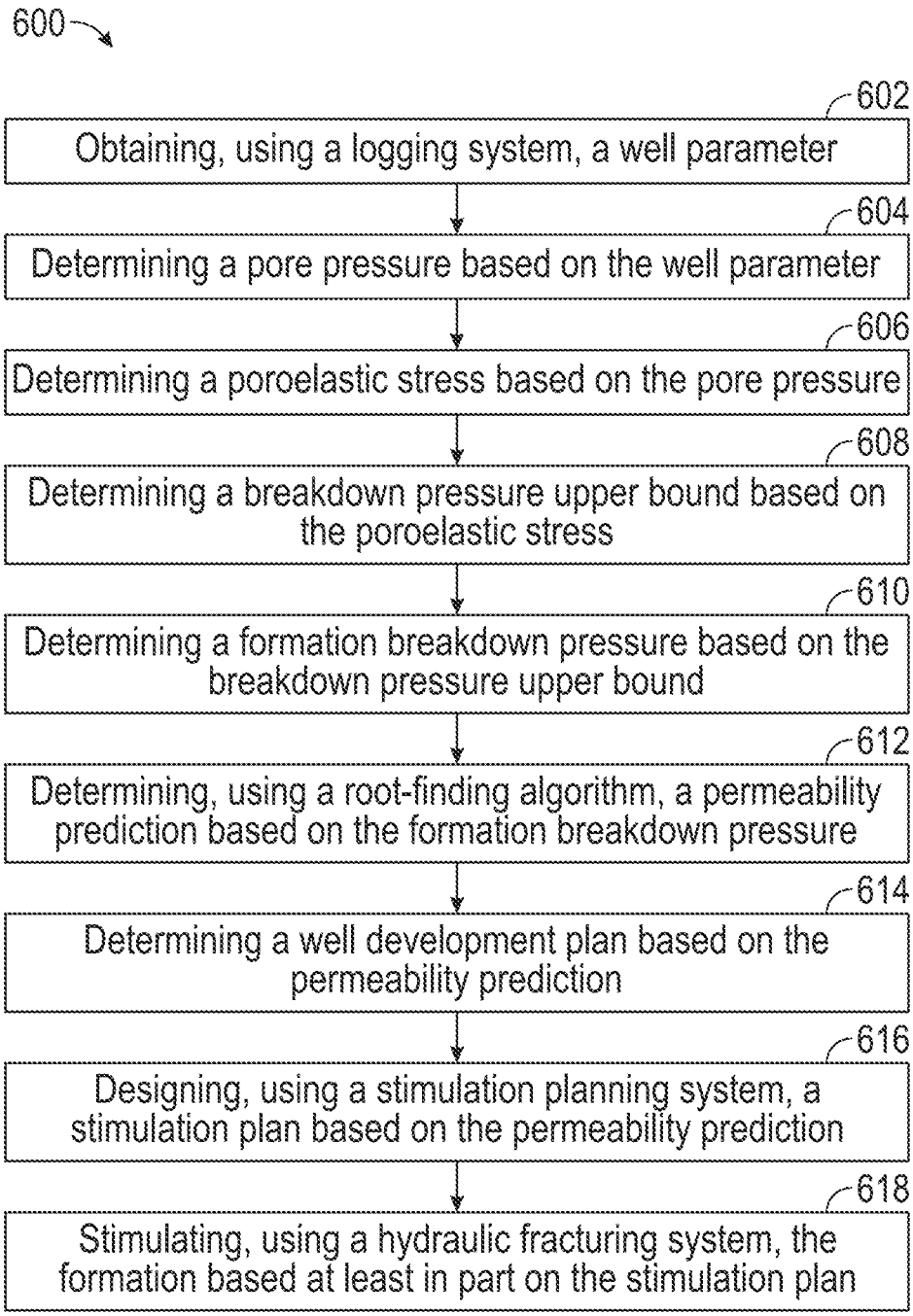
FIG. 6 is a flowchart depicting a method for estimating a formation permeability in accordance with one or more embodiments.

FIG. 6 depicts a formation permeability estimation flowchart in accordance with one or more embodiments describing a method for determining a formation permeability (hereafter "permeability modeling method" (600)). In some embodiments, the permeability modeling method (600) may use the permeability modeling system (10). Although the steps in flowchart using the permeability modeling method (600) are shown in sequential order, it will be apparent to a person having ordinary skill in the art that some steps may be conducted in parallel, in a different order than shown, or may be omitted without departing from the scope of the invention.

In box (602), the permeability modeling method (600) includes obtaining, using the logging system (140), the well parameter (147) in accordance with one or more embodiments. The well parameter (147) may include the wellbore initial pressure, $P_0$, the wellbore radius, $\alpha$ (313), the wellbore inclination (314), $\alpha_b$, and/or the wellbore circumferential angle, $\theta$ (312). In some embodiments, the permeability modeling method (600) includes communicating, using the logging system (140), the well parameter (147) with the formation analysis system (160) in accordance with one or more embodiments. The logging system (140) is communicably coupled to the formation analysis system (160). The formation analysis system (160) may be configured to automatically assess the well parameter (147) based upon input from the logging system (140), such as well logs (145).

In box (604), the permeability modeling method (600) includes determining the pore pressure (513) based on the fluid properties (206), the well parameter (147) and/or the well log data (504) in accordance with one or more embodiments. The fluid properties (206) may include the fluid compressibility, $c_f$, and/or the injection fluid viscosity, $\mu$. The well log data (504) includes the permeability well log data at the plurality of depths (107) where well log data was obtained.

In box (606), the permeability modeling method (600) includes determining the poroelastic stress (514) based on the pore pressure (513), the well parameter (147), and/or the rock properties (205) such as the Biot poroelastic parameter and the Poisson Ratio in accordance with one or more embodiments. The poroelastic parameter may be determined at the plurality of depths (107) or within the depth interval (131) encompassing the reservoir (105) and/or other formations.

In box (608), the permeability modeling method (600) includes determining the breakdown pressure upper bound (420) based on the poroelastic stress (514), the tensile strength, $\sigma_f$, of a rock (200), and/or the in situ stress components in accordance with one or more embodiments. In some embodiments, the permeability modeling method (600) includes applying the effective stress correction (519) to the breakdown pressure upper bound (420).

In box (610), the permeability modeling method (600) includes determining the modeled breakdown pressure (425) based on the breakdown pressure upper bound (420), the pore pressure (513), and/or the poroelastic stress (514) in accordance with one or more embodiments. The modeled breakdown pressure (425) may be determined at the plurality of depths (107) or within the depth interval (131) encompassing the reservoir (105) and/or other formations.

In box (612), the permeability modeling method (600) includes determining, using the root-finding algorithm (533), the permeability prediction (430) based on the modeled breakdown pressure (425) in accordance with one or more embodiments. In some embodiments, the permeability modeling method (600) includes applying the convergence analysis (522) to establish the linear convergence of the permeability prediction (430). In some embodiments, the convergence analysis (522) may show that the permeability prediction algorithm (532) will result in a sequence of the converging permeability prediction that converges to the permeability prediction (430) that includes a unique permeability value.

In box (614), the permeability modeling method (600) includes determining the well development plan (541) based on the permeability prediction (430) in accordance with one or more embodiments. Determining the well development plan (541) may include determining stimulating the formation or repairing the damage done by previous well operations. Determining the well development plan (541) may be done automatically using the machine-learning algorithms (534) such as determining intervals where well remediation operations may be targeted.

In box (616), determining the well development plan (541) includes designing, using a stimulation planning system (550), a stimulation plan (551) based on the permeability prediction (430) in accordance with one or more embodiments. Designing the stimulation plan (551) may be done automatically using the machine-learning algorithms (534). The stimulation plan (551) may target good permeability zones determined by the permeability prediction (430). In box (618), the permeability modeling method (600) includes stimulating, using the hydraulic fracturing system (800), the formation (103) based on the stimulation plan (551) in accordance with one or more embodiments.

In some embodiments, the permeability modeling method (600) includes obtaining, using the injectivity test assembly (121), the breakdown pressure measurement (155). In some embodiments, the permeability modeling method (600) includes comparing the breakdown pressure measurement (155) to the breakdown pressure upper bound (420) yielding a damage comparison. In some embodiments, the permeability modeling method (600) includes determining the permeability damage (450) along the well (100) based on the damage comparison (520). In some embodiments, determining the permeability damage (450) may include determining, using the machine-learning algorithm (534), the permeability damage (450) automatically based on the damage comparison (520).

In some embodiments, the permeability modeling method (600) includes determining the well development plan (541) based on the permeability prediction (430) and the permeability damage (450). In some embodiments, determining the well development plan (541) includes determining, using a remediation planning system (560), a remediation plan based on the permeability damage (450).

In some embodiments, the permeability modeling method (600) includes deploying the well remediation system (900) to carry out well remediation operations on the well based on the remediation plan. The permeability modeling method (600) may include pumping, using the well remediation system (900), acid treatment into the well (100) to repair the permeability damage (450).

In some embodiments, the permeability modeling method (600) includes determining whether the breakdown pressure measurement (155) is less than the breakdown pressure upper bound (420). Determining the well development plan (541) may include continuing normal well operations if the breakdown pressure measurement (155) is less than the breakdown pressure upper bound (420).

FIG. 7 depicts a block diagram of a computer system (700) having a computer (702) used to provide computational functionalities associated with described algorithms, methods, functions, processes, flows, and procedures as described in this disclosure, according to one or more embodiments. The illustrated computer (702) may include a computing device such as a server, desktop computer, laptop/notebook computer, wireless data port, smart phone, personal data assistant (PDA), tablet computing device, one or more processors within these devices, or any other suitable processing device, including both physical or virtual instances (or both) of the computing device. Additionally, the computer (702) may include a computer that includes an input device, such as a keypad, keyboard, touch screen, or other device that can accept user information, and an output device that conveys information associated with the operation of the computer (702), including digital data, visual, or audio information (or a combination of information), or a GUI.

The computer (702) can serve in a role as a client, network component, a server, a database or other persistency, or any other component (or a combination of roles) of a computer system for performing the subject matter described in the instant disclosure. The illustrated computer (702) is communicably coupled with a network (730). In some implementations, one or more components of the computer (702) may be configured to operate within environments, including cloud-computing-based, local, global, or other environments (or a combination of environments).

At a high level, the computer (702) is an electronic computing device operable to receive, transmit, process, store, or manage data and information associated with the described subject matter. According to some implementations, the computer (702) may also include or be communicably coupled with an application server, e-mail server, web server, caching server, streaming data server, business intelligence (BI) server, or other server (or a combination of servers).

The computer (702) can receive requests over network (730) from a client application (for example, executing on another computer (702)) and responding to the received requests by processing the said requests in an appropriate software application. In addition, requests may also be sent to the computer (702) from internal users (for example, from a command console or by other appropriate access method), external or third-parties, other automated applications, as well as any other appropriate entities, individuals, systems, or computers.

Each of the components of the computer (702) can communicate using a system bus (703). In some implementations, any or all of the components of the computer (702), both hardware or software (or a combination of hardware and software), may interface with each other or the interface (704) (or a combination of both) over the system bus (703) using an application programming interface (712) or a service layer (713) (or a combination of the application programming interface (712) and service layer (713). The application programming interface (712) may include specifications for routines, data structures, and object classes. The application programming interface (712) may be either computer-language independent or dependent and refer to a complete interface, a single function, or even a set of application programming interfaces. The service layer (713) provides software services to the computer (702) or other components (whether or not illustrated) that are communicably coupled to the computer (702). The functionality of the computer (702) may be accessible for all service consumers using this service layer. Software services, such as those provided by the service layer (713), provide reusable, defined business functionalities through a defined interface. For example, the interface may be software written in JAVA, C++, or other suitable language providing data in extensible markup language (XML) format or another suitable format. While illustrated as an integrated component of the computer (702), alternative implementations may illustrate the application programming interface (712) or the service layer (713) as stand-alone components in relation to other components of the computer (702) or other components (whether or not illustrated) that are communicably coupled to the computer (702). Moreover, any or all parts of the application programming interface (712) or the service layer (713) may be implemented as child or sub-modules of another software module, enterprise application, or hardware module without departing from the scope of this disclosure.

The computer (702) includes an interface (704). Although illustrated as a single interface (704) in FIG. 7, two or more interfaces (704) may be used according to particular needs, desires, or particular implementations of the computer (702). The interface (704) is used by the computer (702) for communicating with other systems in a distributed environment that are connected to the network (730). Generally, the interface (704) includes logic encoded in software or hardware (or a combination of software and hardware) and operable to communicate with the network (730). More specifically, the interface (704) may include software supporting one or more communication protocols associated with communications such that the network (730) or interface's hardware is operable to communicate physical signals within and outside of the illustrated computer (702).

The computer (702) includes at least one computer processor (705). Although illustrated as a single computer processor (705) in FIG. 7, two or more processors may be used according to particular needs, desires, or particular implementations of the computer (702). Generally, the computer processor (705) executes instructions and manipulates data to perform the operations of the computer (702) and any machine learning networks, algorithms, methods, functions, processes, flows, and procedures as described in the instant disclosure.

The computer (702) also includes a memory (706) that holds data for the computer (702) or other components (or a combination of both) that can be connected to the network (730). For example, memory (706) can be a database storing data consistent with this disclosure. Although illustrated as a single memory (706) in FIG. 7, two or more memories may be used according to particular needs, desires, or particular implementations of the computer (702) and the described functionality. While memory (706) is illustrated as an integral component of the computer (702), in alternative implementations, memory (706) can be external to the computer (702).

The application (707) is an algorithmic software engine providing functionality according to particular needs, desires, or particular implementations of the computer (702), particularly with respect to functionality described in this disclosure. For example, application (707) can serve as one or more components, modules, applications, etc. Further, although illustrated as a single application (707), the application (707) may be implemented as multiple applications (707) on the computer (702). In addition, although illustrated as integral to the computer (702), in alternative implementations, the application (707) can be external to the computer (702).

There may be any number of computers (702) associated with, or external to, a computer system containing a computer (702), wherein each computer (702) communicates over network (730). Further, the term "client," "user," and other appropriate terminology may be used interchangeably as appropriate without departing from the scope of this disclosure. Moreover, this disclosure contemplates that many users may use one computer (702), or that one user may use multiple computers (702).

Figure 8:
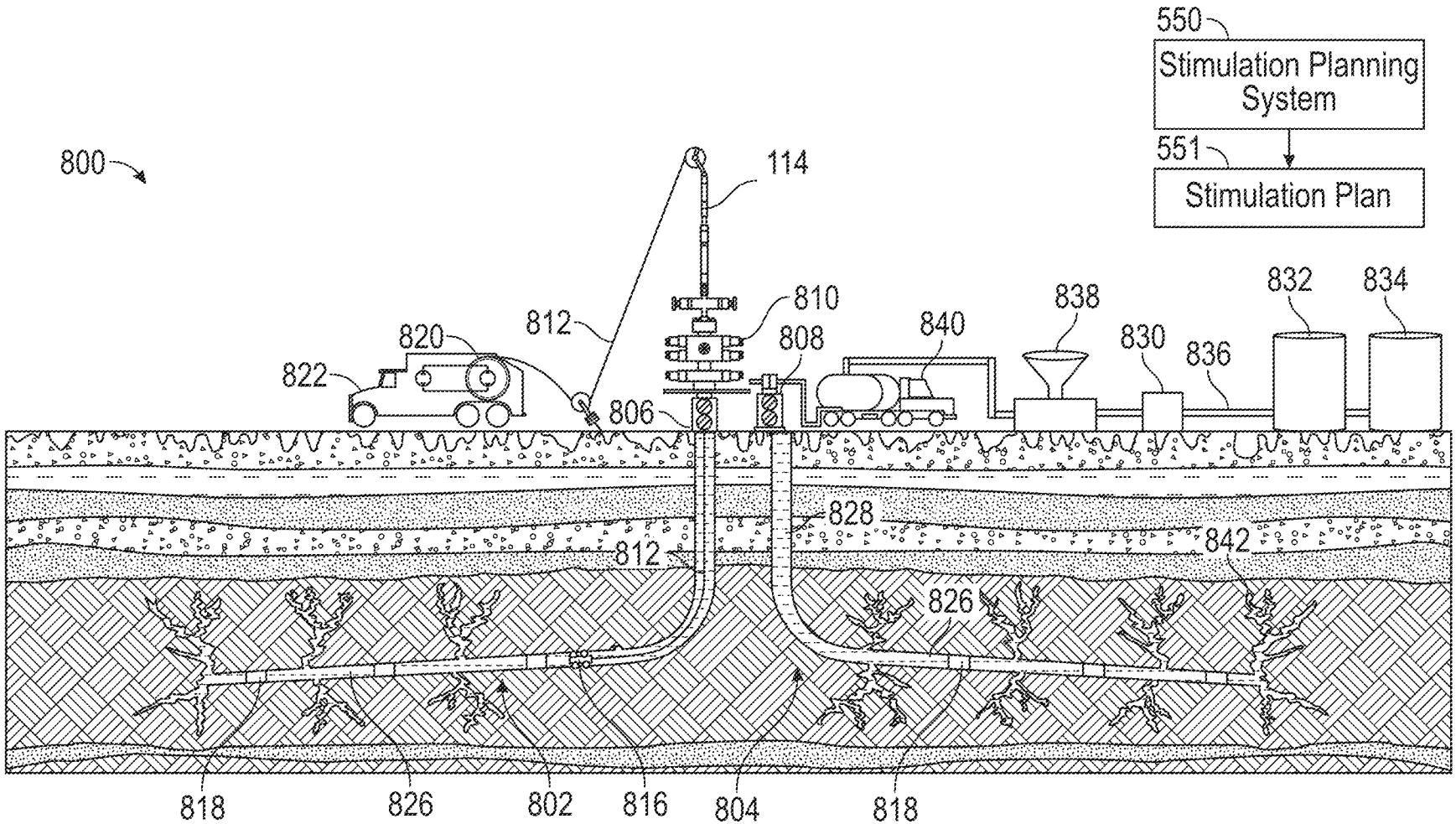
FIG. 8 depicts a hydraulic fracturing system undergoing a stimulation operation according to the stimulation plan developed at least in part by a stimulation planning system in accordance with one or more embodiments.

FIG. 8 shows the hydraulic fracturing system (800) undergoing a stimulation operation according to the stimulation plan (551) design by the stimulation planning system (550) in accordance with one or more embodiments. The particular stimulation operation and the hydraulic fracturing system (800) shown is for illustration purposes only. The scope of this disclosure is intended to encompass any type of hydraulic fracturing system and stimulation operation. In general, a stimulation operation includes two separate operations: a perforation operation and a pumping operation. As such, FIG. 8 shows a stimulation operation occurring on a first well (802) and a second well (804) which may be similar or the same as the well (100) as described in relation to FIG. 1. The first well (802) is undergoing the perforation operation and the second well (804) is undergoing the pumping operation.

The first well (802) and the second well (804) are horizontal wells meaning that each well includes a vertical section and a lateral section. The lateral section is a section of the well that is drilled at least eighty degrees from vertical. The first well (802) is capped by a first frac tree (806) and the second well (804) is capped by a second frac tree (808). A frac tree (806, 808) is similar to a Christmas/production tree but is specifically installed for the stimulation operation. Frac trees (806, 808) tend to have larger bores and higher-pressure ratings than a Christmas/production tree would have. Further, stimulation operations require abrasive materials being pumped into the well at high pressures, so the frac tree (806, 808) is designed to handle a higher rate of erosion.

In accordance with one or more embodiments, the perforating operation includes installing a wireline blow out preventor (BOP) (810) onto the first frac tree (806). A wireline BOP (810) is similar to a drilling BOP; however, a wireline BOP (810) has seals designed to close around (or shear) wireline (812) rather than drill pipe. The wireline (812) is maneuvered by a wireline truck (822) and a wireline spool (820). A lubricator (814) is connected to the opposite end of the wireline BOP (810). A lubricator (814) is a long, high-pressure pipe used to equalize downhole pressure and atmosphere pressure in order to run downhole tools, such as a perforating gun (816), into the well.

When the perforating gun (816) reaches a predetermined depth, a message is sent along the wireline (812) to set the frac plug (818). After the frac plug (818) is set, another message is sent through the wireline (812) to detonate the explosives, as shown in FIG. 8. The explosives create perforations in casing (826) and in the surrounding formation. There may be more than one set of explosives on a singular perforating gun (816), each detonated by a distinct message. Multiple sets of explosives are used to perforate different depths along the casing (826) for a singular stage.

Further, the frac plug (818) may be set separately from the perforation operation without departing from the scope of the disclosure herein.

As explained above, FIG. 8 shows the second well (804) undergoing the pumping operation after the fourth stage perforating operation has already been performed and perforations are left behind in the casing (826) and the surrounding formation. A pumping operation includes pumping a frac fluid (828) into the perforations in order to propagate the perforations and create fractures (842) in the surrounding formation. The frac fluid (828) often comprises a certain percentage of water, proppant, and chemicals.

FIG. 8 also shows chemical storage containers (830), water storage containers (832), and proppant storage containers (834) located on the hydraulic fracturing system (800). Frac lines (836) and transport belts (not pictured) transport the chemicals, proppant, and water from the storage containers (830, 832, 834) into a frac blender (838). The frac blender (838) blends the water, chemicals, and proppant to become the frac fluid (828). The frac fluid (828) is transported to one or more frac pumps, often pump trucks (840), to be pumped through the second frac tree (808) into the second well (804). The frac fluid (828) is transported from the pump truck (840) to the second frac tree (808) using a plurality of frac lines (836). The fluid pressure propagates and creates the fractures (842) while the proppant props open the fractures (842) once the pressure is released.

Figure 9:
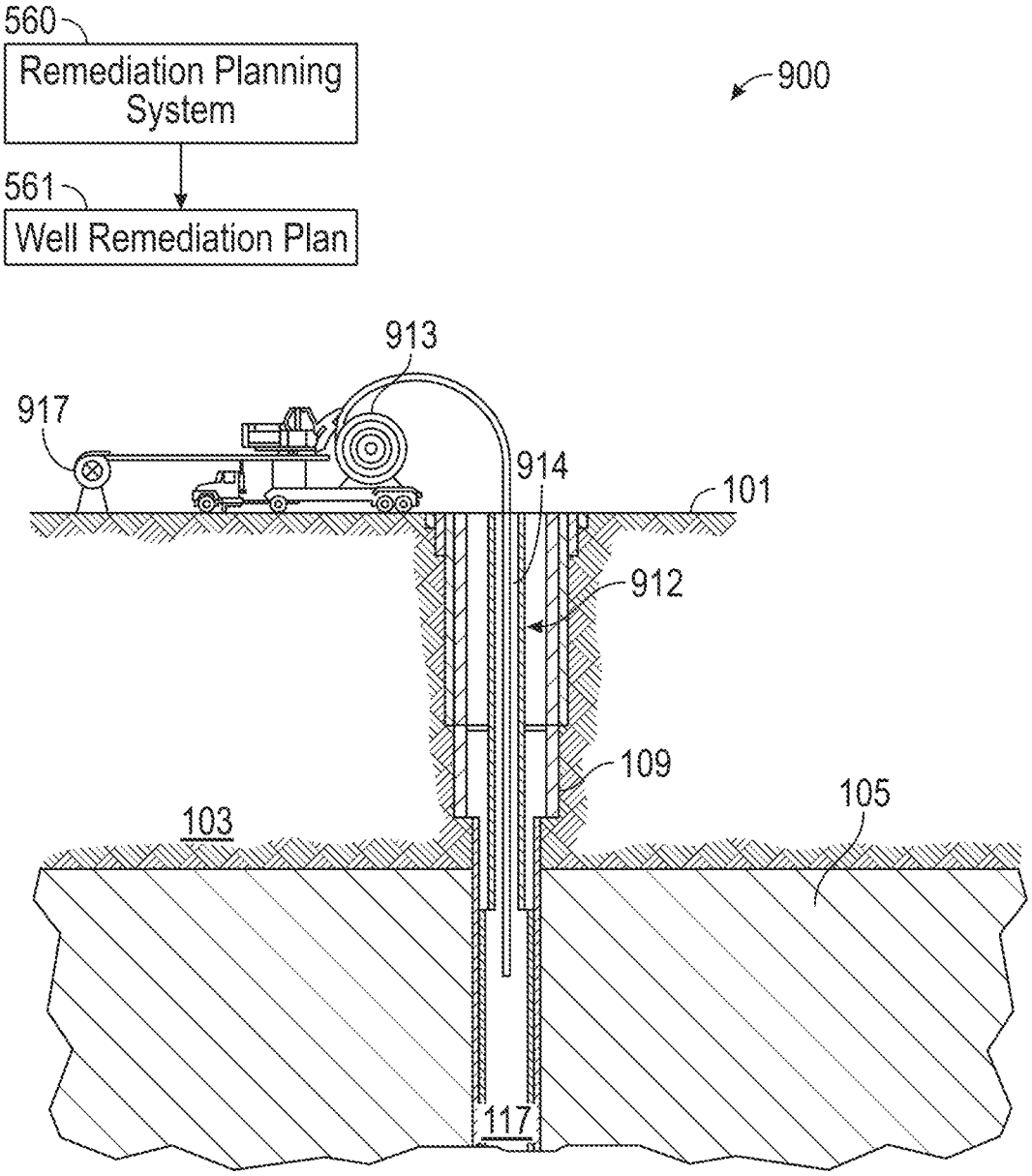
FIG. 9 depicts a well remediation system performing a well remediation operation for treating the reservoir based on ta well remediation plan developed at least in part by a remediation planning system in accordance with one or more embodiments.

FIG. 9 is a schematic representation of an embodiment of the well remediation system (900) performing a well remediation operation for treating the reservoir (105) via a well (914) similar or same as the well (100) as described in relation to FIG. 1. For simplicity of viewing, only the components of the well (914) pertinent to the well remediation operations are shown. The well remediation operation may be based on the well remediation plan (561) designed by the remediation planning system (560). The reservoir (105) is depicted having a wellbore wall (109) both extending downward from the surface (101) into the reservoir (105) through one or more formations (103) and defining the wellbore (117). Production liner (912) and a coiled tubing (913) extend downwards through the wellbore (117) towards the reservoir (105). The production liner may be perforated as described in relation to FIG. 8.

The first remediation treatment such as an acid treatment is introduced into the reservoir (105) via a pump (917) through the coiled tubing (913). In some embodiments, a second remediation treatment may be introduced through the production liner (912). In an alternative embodiment, the first remediation treatment is introduced via a production tubing and the second remediation treatment is introduced via a production tubing, and both solutions may be introduced simultaneously. The remediation treatments penetrate the reservoir (105) through the perforations in the production liner (912).

Embodiments of the present disclosure may provide at least one of the following advantages. The permeability modeling method provides a permeability prediction that can be used to design a stimulation plan. The permeability prediction is potentially more accurate than other methods. The permeability prediction relies on the breakdown pressure measurement which is typically the first physical measurement of a formation. The permeability modeling method may provide reduction in well development times in being able to plan stimulation operations sooner in the life cycle of the well since the permeability prediction may be obtained sooner in the well development life cycle.

Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims.

What is claimed is:

1. A system for determining formation permeability along a well within a formation, the system comprising:

a logging system configured to obtain a well parameter of the well;

an injectivity test assembly configured to obtain a breakdown pressure measurement during drilling operations and further configured to inject an injection fluid into a newly drilled portion of the well to determine a breakdown pressure measurement by inducing a fracture in the formation;

a formation analysis system configured to:

determine a pore pressure based on the well parameter, determine a poroelastic stress based on the pore pressure, determine a breakdown pressure upper bound based on the poroelastic stress, determine a modeled breakdown pressure based on the breakdown pressure upper bound, determine, using a root-finding algorithm, a permeability prediction based on the modeled breakdown pressure, compare the breakdown pressure measurement to the breakdown pressure upper bound to yield a damage comparison, determine a permeability damage along the well based on the damage comparison, and identify a damaged location in the well based on the permeability damage, wherein the damaged location is a portion of the well where the modeled breakdown pressure is less than the breakdown pressure measurement; and a well development planning system configured to:

determine a well development plan based at least in part on the permeability prediction and the permeability damage;

execute the well development plan to repair the damaged location by introducing a remediation treatment into the well.

2. The system of claim 1, wherein the logging system is communicably coupled to the formation analysis system, and wherein the formation analysis system is configured to automatically assess the well parameter based upon input from the logging system.

3. The system of claim 1, wherein the formation analysis system is further configured to apply an effective stress correction to the breakdown pressure upper bound.

4. The system of claim 1, further comprising:

a stimulation planning system configured to design a stimulation plan based on the permeability prediction; and a hydraulic fracturing system configured to stimulate the formation based on the stimulation plan.

5. The system of claim 1, wherein the root-finding algorithm comprises a bisection method algorithm.

6. The system of claim 1, further comprising:

a remediation planning system configured to determine a well remediation plan based on the permeability damage; and a well remediation system is configured to carry out the remediation treatment on the well based on the well remediation plan;

wherein the remediation treatment comprises an acid treatment introduced into the well.

7. The system of claim 1, wherein the formation analysis system is further configured to determine whether the breakdown pressure measurement is greater than the breakdown pressure upper bound, wherein the well development planning system is configured to continue normal well operations if the breakdown pressure measurement is less than the breakdown pressure upper bound.

8. The system of claim 1, wherein the formation analysis system comprises a machine-learning algorithm configured to determine a formation permeability damage automatically based at least in part on the damage comparison.

9. The system of claim 1, wherein the formation analysis system is configured to apply a convergence analysis to establish a linear convergence of the permeability prediction.

10. A method for determining formation permeability along a well within a formation, the method comprising:

obtaining, using a logging system, a well parameter;

determining a pore pressure based on the well parameter;

determining a poroelastic stress based on the pore pressure;

determining a breakdown pressure upper bound based on the poroelastic stress;

determining a modeled breakdown pressure based on the breakdown pressure upper bound;

determining, using a root-finding algorithm, a permeability prediction based on the modeled breakdown pressure;

obtaining, using an injectivity test assembly, a breakdown pressure measurement during drilling operations, wherein the injectivity test assembly injects an injection fluid into a newly drilled portion of the well to determine the breakdown pressure measurement by inducing a fracture in the formation;

comparing the breakdown pressure measurement to the breakdown pressure upper bound to yield a damage comparison;

determining a permeability damage along the well based on the damage comparison;

identifying a damaged location in the well based on the permeability damage, wherein the damaged location is a portion of the well where the modeled breakdown pressure is less than the breakdown pressure measurement;

determining a well development plan based on the permeability prediction and the permeability damage; and executing the well development plan to repair the damaged location by introducing a remediation treatment into the well.

11. The method of claim 10, further comprising:

communicating, using the logging system, the well parameter with a formation analysis system, wherein the logging system is communicably coupled to the formation analysis system allowing the well parameter to be analyzed automatically.

12. The method of claim 10, further comprises applying an effective stress correction to the breakdown pressure upper bound.

13. The method of claim 10, determining the well development plan comprises:

designing, using a stimulation planning system, a stimulation plan based on the permeability prediction; and stimulating, using a hydraulic fracturing system, the formation based on the stimulation plan.

14. The method of claim 10, determining the well development plan comprises:

determining, using a remediation planning system, a well remediation plan based on the permeability damage; and deploying a well remediation system to carry out a remediation treatment on the well based on the well remediation plan;

wherein the remediation treatment comprises an acid treatment introduced into the well.

15. The method of claim 10, the method further comprises:

determining whether the breakdown pressure measurement is less than the breakdown pressure upper bound, wherein determining the well development plan comprises continuing normal well operations if the breakdown pressure measurement is less than the breakdown pressure upper bound.

16. The method of claim 10, wherein determining the permeability damage comprises forming, using a machine-learning algorithm, the permeability damage automatically based on the damage comparison.

17. The method of claim 10, further comprising applying a convergence analysis to establish a linear convergence of the permeability prediction.

18. A computer-readable medium storing instructions for a method for determining formation permeability along a well within a formation, the method comprising:

obtaining, using a logging system, a well parameter;

determining a pore pressure based on the well parameter;

determining a poroelastic stress based on the pore pressure;

determining a breakdown pressure upper bound based on the poroelastic stress;

determining a modeled breakdown pressure based on the breakdown pressure upper bound;

determining, using a root-finding algorithm, a permeability prediction based on the modeled breakdown pressure;

applying a convergence analysis to establish a linear convergence of the permeability prediction;

obtaining, using an injectivity test assembly, a breakdown pressure measurement during drilling operations wherein the injectivity test assembly injects an injection fluid into a newly drilled portion of the well to determine the breakdown pressure measurement by inducing a fracture in the formation;

comparing the breakdown pressure measurement to the breakdown pressure upper bound yielding a damage comparison;

determining, during drilling operations, a permeability damage along the well based on the damage comparison, wherein determining the permeability damage comprises forming, using a machine-learning algorithm, the permeability damage automatically based on the damage comparison;

identifying a damaged location in the well based on the permeability prediction, wherein the damaged location is a portion of the well where the modeled breakdown pressure is less than the breakdown pressure measurement;

determining a well development plan based on the permeability prediction and the permeability damage;

wherein determining the well development plan comprises determining, using a remediation planning system, a well remediation plan based on the permeability damage;

executing the well development plan by controlling a drillstring of a drilling system; and executing, with a well remediation system, a remediation treatment on the damaged location based on the well remediation plan;

wherein the remediation treatment comprises introducing an acid treatment into the well.

* * * * *